US008794318B2

(12) United States Patent
Harrigan et al.

(10) Patent No.: US 8,794,318 B2
(45) Date of Patent: Aug. 5, 2014

(54) FORMATION EVALUATION INSTRUMENT AND METHOD

(75) Inventors: Edward Harrigan, Richmond, TX (US); Yves Barriol, Houston, TX (US); Andrei I. Davydychev, Sugar Land, TX (US); Andrew J. Carnegie, Sri Bukit Persekutuan (MY); Dean M. Homan, Sugar Land, TX (US); Srinand Karuppoor, Sugar Land, TX (US); Yi-Qiao Song, Newton Center, MA (US); Tim Hopper, Cambridge, MA (US); Henry N. Bachman, Missouri City, TX (US); William B. Vandermeer, Cypress, TX (US); Anthony L. Collins, Houston, TX (US); Mark A. Fredette, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 427 days.

(21) Appl. No.: 13/002,913

(22) PCT Filed: Jul. 9, 2009

(86) PCT No.: PCT/US2009/050071

§ 371 (c)(1),
(2), (4) Date: Mar. 29, 2011

(87) PCT Pub. No.: WO2010/008994

PCT Pub. Date: Jan. 21, 2010

(65) Prior Publication Data

US 2011/0198078 A1 Aug. 18, 2011

Related U.S. Application Data

(60) Provisional application No. 61/080,320, filed on Jul. 14, 2008.

(51) Int. Cl.
*E21B 49/00* (2006.01)
*E21B 49/06* (2006.01)

(52) U.S. Cl.
USPC ..... 166/264; 166/250.01; 166/100; 175/58; 73/152.41

(58) Field of Classification Search
USPC ..... 166/250.1, 264, 100; 175/58; 73/152.39, 152.41
See application file for complete search history.

(56) References Cited

U.S. PATENT DOCUMENTS 4,547,691 A 10/1985 Valdois et al.
4,860,581 A 8/1989 Zimmerman et al.

(Continued)

FOREIGN PATENT DOCUMENTS

WO 2010008684 1/2010

OTHER PUBLICATIONS

Montaron, Bernard, A Quantitative Model for the Effect of Wettability on the Conductivity of Porous Rocks, SPE 10541, 15th SPE Middle East & Oil Show and Conference, Bahrain, Mar. 11-14, 2007.

(Continued)

*Primary Examiner* — Cathleen Hutchins
(74) *Attorney, Agent, or Firm* — Cathy Hewitt

(57) ABSTRACT

Subsurface formation evaluation comprising, for example, sealing a portion of a wall of a wellbore penetrating the formation, forming a hole through the sealed portion of the wellbore wall, injecting an injection fluid into the formation through the hole, and determining a saturation of the injection fluid in the formation by measuring a property of the formation proximate the hole while maintaining the sealed portion of the wellbore wall.

13 Claims, 13 Drawing Sheets

(56) References Cited

U.S. PATENT DOCUMENTS

| | | | |
|---|---|---|---|
| 5,335,542 | A | 8/1994 | Ramakrishnan et al. |
| 5,394,345 | A | 2/1995 | Berard et al. |
| 5,692,565 | A | 12/1997 | MacDougall et al. |
| 6,371,221 | B1 | 4/2002 | Harrigan et al. |
| 6,528,995 | B1 | 3/2003 | Speier et al. |
| 6,856,132 | B2 | 2/2005 | Appel et al. |
| 7,002,142 | B2 | 2/2006 | Mullins et al. |
| 7,032,661 | B2 | 4/2006 | Georgi et al. |
| 7,075,063 | B2 | 7/2006 | Dong et al. |
| 7,114,562 | B2 | 10/2006 | Fisseler et al. |
| 7,191,831 | B2 | 3/2007 | Reid et al. |
| 7,195,063 | B2 | 3/2007 | Nogueira et al. |
| 7,347,262 | B2 | 3/2008 | Tarvin et al. |
| 7,379,180 | B2 | 5/2008 | Vannuffelen et al. |
| 7,380,599 | B2 | 6/2008 | Fields et al. |
| 7,431,107 | B2 | 10/2008 | Hill et al. |
| 7,878,243 | B2 | 2/2011 | Goodwin et al. |
| 8,593,140 | B2 | 11/2013 | Saldungaray et al. |
| 2004/0000905 | A1* | 1/2004 | Freedman et al. ..... 324/303 |
| 2005/0179437 | A1 | 8/2005 | Hayman et al. |
| 2006/0000606 | A1 | 1/2006 | Fields et al. |
| 2008/0066535 | A1 | 3/2008 | Vasques et al. |
| 2008/0066536 | A1 | 3/2008 | Goodwin et al. |
| 2008/0066537 | A1 | 3/2008 | Hegeman et al. |
| 2008/0257036 | A1 | 10/2008 | Chaudoreille et al. |
| 2013/0233619 | A1 | 9/2013 | Ramannoorthy et al. |

OTHER PUBLICATIONS

Dong, C. et al., New Downhole-Fluid-Analysis Tool for Improved Reservoir Characterization, SPE 108566, Society of Petroleum Engineers, Dec. 2008, pp. 1107-1116.

Donaldson, et al., "Relationship between the Archie Saturation Exponent and Wettability", SPE 16790, SPE Formation Evaluation, Sep. 1989, pp. 359-362.

* cited by examiner

FORMATION EVALUATION INSTRUMENT AND METHOD

CROSS-REFERENCE TO RELATED APPLICATIONS

This application claims the benefit of U.S. Provisional Application No. 61/080,320, entitled "FORMATION EVALUATION INSTRUMENT AND METHOD FOR MEASURING PETROPHYSICAL PROPERTIES IN RESPONSE TO FLUID INJECTION INTO OR WITHDRAWAL FROM A FORMATION," filed Jul. 14, 2008, the disclosure of which is hereby incorporated herein by reference.

BACKGROUND OF THE DISCLOSURE

It may be desirable to measure the response of permeable subsurface formations to the flow of fluids in the pore spaces of such formations. For example, the determination of effective permeabilities of water, oil or gas, residual oil saturations, irreducible water saturations, and rock wettabilities, among other petrophysical parameters, may be very useful in gauging the producibility of hydrocarbon bearing formations. Downhole testing tools may be used for making permeability and/or other hydraulic property measurements of subsurface formations surrounding wellbores. Descriptions of such tools may be found, for example, in U.S. Pat. Nos. 5,335,542, 6,528,995, 6,856,132 and 7,032,661, the disclosures of which are incorporated herein by reference.

Various factors may restrict movement of fluid between subsurface formations and downhole testing tools. For example, during drilling of a wellbore, particles from the mud may plug the pore spaces of permeable rock formations close to the wellbore wall and create a "damaged zone" or "permeability skin" Downhole testing tools may use a perforation through a portion of the wellbore wall, for example to establish a fluid communication therethrough. Descriptions of such tools may be found, for example, in U.S. Pat. No. 7,191,831 and U.S. Patent Application Pub. Nos. 2006/0000606, 2008/0066536 and 2008/0066537, the disclosures of which are incorporated herein by reference.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
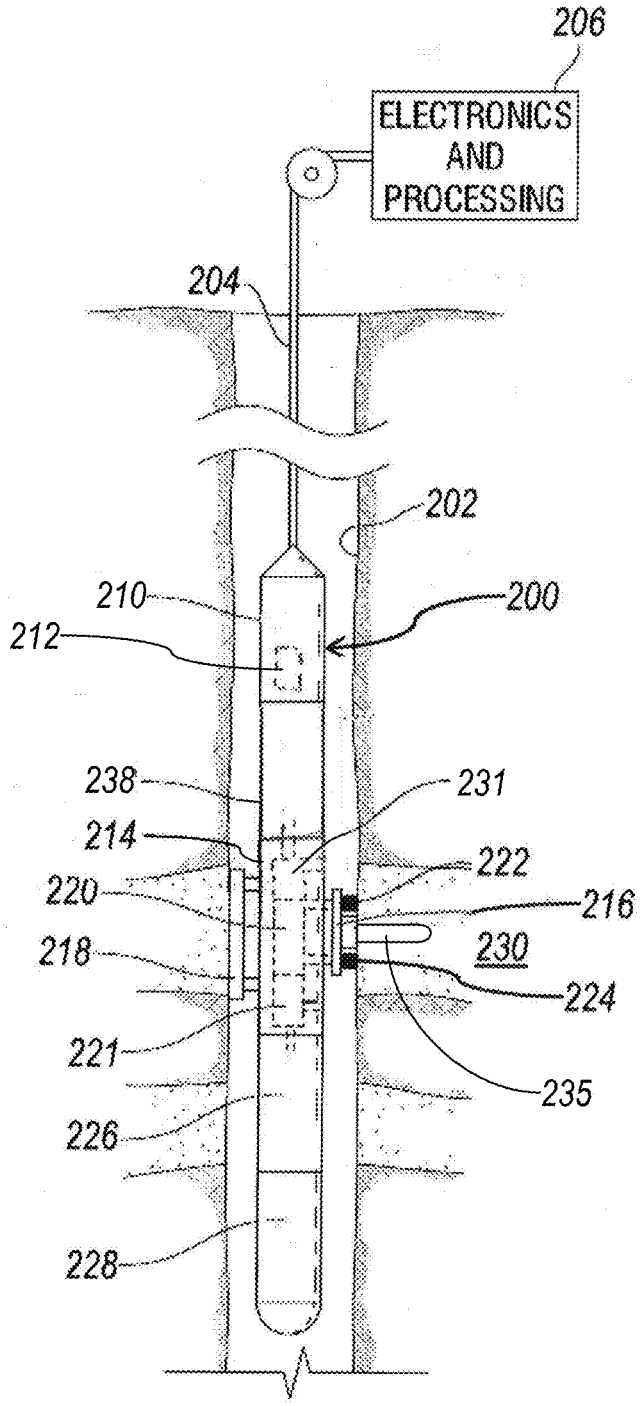
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

During and after drilling of a wellbore, connate fluid in the pore spaces of permeable formations may become partially or totally displaced by a filtrate phase of the wellbore fluid (or "drilling mud") used to drill the wellbore and evacuate the drill cuttings. Wellbore fluid may seep into the formation due to the increased pressure in the wellbore with respect to the pressure of the connate fluid in the formation, and may create a so called "invaded zone". The lateral depth of the invaded zone from the wellbore wall may depend on, among other factors, the type of drilling fluid used to drill the wellbore, the hydrostatic or hydrodynamic fluid pressure in the wellbore, the fluid pressure in the formation, the fractional volume of pore space ("porosity") of the formation, and the time lapse occurred since drilling the wellbore. The term "lateral depth" as used herein is intended to denote the distance from the wellbore wall in a direction perpendicular to the longitudinal axis of the wellbore. Effects of such invaded zone may include, for example, chemical reactions between the mud filtrate and the formation rock and contamination of fluid samples by mud filtrate. Thus, the invaded zone may affect and sometimes prevent the measurements of some petrophysical parameters.

Further, particles in suspension in the wellbore fluid may accumulate in a shallow layer of the formation proximate the wellbore wall, and such may clog the pore spaces of the permeable rock formations. The particle accumulation may create a "damaged zone" or "permeability skin" which restricts movement of fluid between the reservoir formation and the testing tool. The lateral depth of the damaged zone from the wellbore wall may depend on, among other factors, the chemical composition of the drilling fluid, the physical nature of the solids in the drilling fluid used to drill the wellbore, the differential pressure between the hydrostatic or hydrodynamic fluid pressure in the wellbore and the fluid pressure in the formation, the initial permeability of the formation, the pore size distribution, and the fractional volume of pore space ("porosity") of the formation. In addition, the particles also form a substantially impermeable layer on the wellbore wall sometimes referred to as a "mud cake". Both the damaged zone and the mud cake may limit the flow of injected fluid into the formation, and/or of formation fluid into a downhole tester. Thus, both the damaged zone and the mud cake may affect and sometimes prevent the measurement of some petrophysical parameters.

Methods and apparatus for measuring petrophysical parameters that may be less affected by the fluid displacement described above are described herein. The methods and apparatus of the present disclosure may be used to measure petrophysical parameters while injecting fluid into or withdrawing fluid from a subsurface formation. For example, the methods and apparatus of the present disclosure may be used to measure the response of permeable formations to the injection of fluids into the pore spaces of portions of the subsurface formations.

In accordance with one or more aspects of the present disclosure, a formation evaluation apparatus may be positioned within a wellbore drilled through subsurface formations. The formation evaluation apparatus may be moved along the interior of the wellbore using an armored electrical cable ("wireline"), but may alternatively be conveyed any other manner known in the art and/or future developed. Conveyance manners known in the art include coupling the formation evaluation apparatus within a drill string (i.e., conveyed "while-drilling"), affixing the formation evaluation apparatus to the end of a coiled tubing, on a "slickline" or on production tubing, for example. The manner of conveyance is not intended in any way to limit the scope of the present disclosure.

In accordance with one or more aspects of the present disclosure, a sealing member, such as a probe seal, may be used for sealing off a portion of the wall of the wellbore penetrating a formation. Thus, fluid communication between the formation evaluation apparatus and the formation may be localized in a relatively small area, corresponding to the area of a port in the sealing member. In contrast with other sealing members, such as dual or straddle packers, a probe seal may have the advantage that the flow characteristics induced in the formation by the probe may be better determined (e.g., more uniform, well correlated to the pumping rate prescribed by the testing tool, etc). Also, the maximum flow rate of fluids close to the port in the sealing member that may be achieved using a downhole pump may be larger when using a probe than when using a straddle packer. This may be used to advantage in high mobility formations to perform tests over a relatively large range of flow rates. For example, sweep efficiency of the formation fluids by the injected fluids may be better determined at high flow rates and may provide more accurate measurements of residual oil saturation and/or other parameters. However, the manner of implementing a sealing member is not intended in any way to limit the scope of the present disclosure.

In accordance with one or more aspects the present disclosure, a drill bit, coring bit, and/or other perforating mechanism may be used to extend a hole through the mud cake and/or the damaged zone laterally through the wellbore wall and into the undamaged zone of the formation. As will be appreciated by those skilled in the art, the undamaged zone may include rock formation having substantially undisturbed permeability. Thus, the hole may bypass the portion of the formation that has reduced permeability. By doing so, the pressure required to inject fluid through the hole and into the formation may be low, which may reduce the risk of unintentionally fracturing the formation and/or loosing the seal with the formation. Further, the hole may extend through the invaded zone laterally proximate the wellbore and into the un-invaded zone of the formation. As will be appreciated by those skilled in the art, the un-invaded zone may include substantially entirely connate fluid within the pore spaces of the formation.

In accordance with one or more aspects the present disclosure, one or more petrophysical parameters, for example, parameters that are related to the fluid content (e.g., oil saturation) of the formation, or fluid flow in the formation may be measured before, during or after the pumping of fluid into and/or from the formation. Such measurements and pumping may be performed without the need to break the seal created against the wellbore wall. Thus, the pressure in the perforation may be maintained close to the wellbore pressure (and optionally below the formation pressure) during measurement, which may prevent or reduce re-invasion of the tested region by the wellbore fluid, or at least further movement of wellbore fluid while a measurement is being made after a fluid injection. Such measurement may enable determination of petrophysical parameter(s), such as saturation levels, as the volume of fluid pumped into the formation changes.

In accordance with one or more aspects the present disclosure, a plurality of injection fluids may be provided downhole. One or more of these injection fluids may be introduced in the formation and petrophysical measurements may be performed before, during or after the injection. In making petrophysical measurements, the sensors used to make the particular measurements may be configured such that the lateral depth into the formation from the wellbore in which the measurement is made generally corresponds to the lateral depth at which the fluid is injected into the formation. In this way, flow heterogeneity in the formation, saturation levels of injected and/or connate fluids, resistivity response of the formation due to different saturation levels of injected fluids, among others, may be determined. This information may in turn be used to estimate recoverable reserves, or to improve the oil recovery of the reservoir, among other uses.

The formation evaluation apparatus and methods disclosed herein may be used to determine petrophysical property values (e.g., permeability values) that are less affected by the mud cake and/or the damaged zone, and are more representative of the formation. In other words, a particular advantage that may be provided is that the formation evaluation apparatus may be in fluid communication with a portion of the formation that is relatively unaffected by the solid particles and/or the drilling fluid used to drill the wellbore. Further, the formation evaluation apparatus and methods disclosed herein may be used to determine petrophysical property values (e.g., residual oil saturation, rock wettability) within a zone of the formation that has not been invaded by wellbore fluid filtrate.

Turning to FIG. 1, an example well site system according to one or more aspects of the present disclosure is shown. The well site may be situated onshore (as shown) or offshore. A wireline tool 200 may be configured to seal a portion of a wall of a wellbore 202 penetrating a subsurface formation 230, and form a hole 235 through the sealed portion of the wellbore wall. The wireline tool 200 may further be configured to inject an injection fluid into the formation 230 through the hole 235, and determine a saturation of the injection fluid in the formation by measuring a property of the formation proximate the hole while maintaining the sealed portion of the wellbore wall.

The example wireline tool 200 may be suspended in the wellbore 202 from a lower end of a multi-conductor cable 204 that may be spooled on a winch (not shown) at the Earth's surface. At the surface, the cable 204 may be communicatively coupled to an electronics and processing system 206. The electronics and processing system 206 may include a controller having an interface configured to receive commands from a surface operator. In some cases, the electronics and processing system 206 may further include a processor configured to implement one or more aspects of the methods described herein.

The example wireline tool 200 may include a telemetry module 210, a sample carrier module 238, a formation tester 214, and injection fluid carrier modules 226, 228. Although the telemetry module 210 is shown as being implemented separate from the formation tester 214, the telemetry module 210 may be implemented in the formation tester 214. Additional components may also be included in the tool 200.

The formation tester 214 may comprise a selectively extendable probe assembly 216 and a selectively extendable tool anchoring member 218 that are respectively arranged on opposite sides of the body 208. The probe assembly 216 may be configured to selectively seal off or isolate selected portions of the wall of the wellbore 202. The probe assembly 216 may include a perforating mechanism (not shown in FIG. 1) configured to form the hole 235 through the formation 230 beyond the wall of the wellbore 202. A probe seal may be associated with the perforating mechanism and may be configured to substantially prevent movement of fluid into or out of the formation 230 other than through the hole 235. Thus, the probe seal may be configured to fluidly couple components of the formation tester 214, for example, pumps 221 and/or 231, to the adjacent formation 230 via the hole 235.

The formation tester 214 may be used to obtain fluid samples from the formation 230, for example by extracting fluid from the formation using the pump 231. A fluid sample may thereafter be expelled through a port into the wellbore or the sample may be sent to one or more fluid collecting chambers disposed in the sample carrier module 238. In turn, the fluid collecting chambers may receive and retain the formation fluid for subsequent testing at the surface or a testing facility. Alternatively, or additionally, the sampled fluid may segregate in the sample carrier module 238. One segregated portion of the fluid may selectively be removed from the sample carrier module and transferred into one or more fluid collecting chambers of the injection fluid carrier modules 226, 228. For example, the formation tester 214 may be provided with a sampling system of a type described in U.S. Pat. No. 7,195,063, the disclosure of which is incorporated herein by reference.

The formation tester 214 may also be used to discharge injection fluid into the formation 230, for example, by moving the injection fluid from one or more fluid collecting chambers disposed in the injection fluid carrier modules 226, 228 using the pump 221. The injection fluid may be moved from the one or more fluid collecting chambers by applying hydrostatic pressure from within the wellbore to a sliding the piston disposed in the collecting chamber, in addition to or in substitution of using the pump 221. While the wireline tool 200 is depicted as having pumps 220 and 221, a single reversible pump may be provided on the wireline tool 200.

The probe assembly 216 of the formation tester 214 may be provided with a plurality of sensors 222 and 224 disposed adjacent to a port of the probe assembly 216. The sensors 222 and 224 may be configured to determine petrophysical parameters (e.g., saturation levels) of a portion of the formation 230 proximate the probe assembly 216. For example, the sensors 222 and 224 may be configured to measure or detect one or more of electric resistivity, dielectric constant, magnetic resonance relaxation time, nuclear radiation, and/or combinations thereof.

The formation tester 214 may be provided with a fluid sensing unit 220 through which the obtained fluid samples and/or injected fluids may flow and which is configured to measure properties and/or composition data of the flowing fluids. For example, the fluid sensing unit 220 may include a fluorescence sensor, such as described in U.S. Pat. Nos. 7,002,142 and 7,075,063, incorporated herein by reference. The fluid sensing unit 220 may alternatively or additionally include an optical fluid analyzer, for example as described in U.S. Pat. No. 7,379,180, incorporated herein by reference. The fluid sensing unit 220 may alternatively or additionally comprise a density and/or viscosity sensor, for example as described in U.S. Patent Application Pub. No. 2008/0257036, incorporated herein by reference. The fluid sensing unit 220 may alternatively or additionally include a high resolution pressure and/or temperature gauge, for example as described in U.S. Pat. Nos. 4,547,691 and 5,394,345, incorporated herein by reference. An implementation example of sensors in the fluid sensing unit 220 may be found in "New Downhole-Fluid Analysis-Tool for Improved Formation Characterization" by C. Dong, et al., SPE 108566, December 2008. It should be appreciated, however, that the fluid sensing unit 220 may include any combination of conventional and/or future-developed sensors within the scope of the present disclosure.

The telemetry module 210 may comprise a downhole control system 212 communicatively coupled to the electrical control and data acquisition system 206. The electrical control and data acquisition system 206 and/or the downhole control system 212 may be configured to control the probe assembly 216, the extraction of fluid samples from the formation 230, and/or the injection of fluids into the formation 230, for example via the pumping rate of pumps 221 and/or 231. The electrical control and data acquisition system 206 and/or the downhole control system 212 may be further configured to control the forming of the hole 235.

The electrical control and data acquisition system 206 and/or the downhole control system 212 may be further configured to analyze and/or process data obtained, for example, from downhole sensors disposed in the fluid sensing unit 220 and/or from the sensors 222 and 224, store measurements or processed data, and/or communicate measurements or processed data to the surface or another component for subsequent analysis. For example, a formation dielectric constant and/or a formation magnetic resonance relaxation time distribution measured by at least one of the sensors 222 and 224 may be processed to determine one or more of a connate fluid saturation (e.g., water, gas and/or oil), and an injected fluid saturation. Additionally, a formation electric resistivity measured by at least one of the sensors 222 and 224 may be correlated with the determined saturations to determine a relationship between saturation and electric resistivity of the formation. Also, composition data measured with the fluid sensing unit 220 and flow rate induced by the pump 220 and/or 221 may be correlated with the determined saturations to determine effective permeability curves.

Figure 2A:
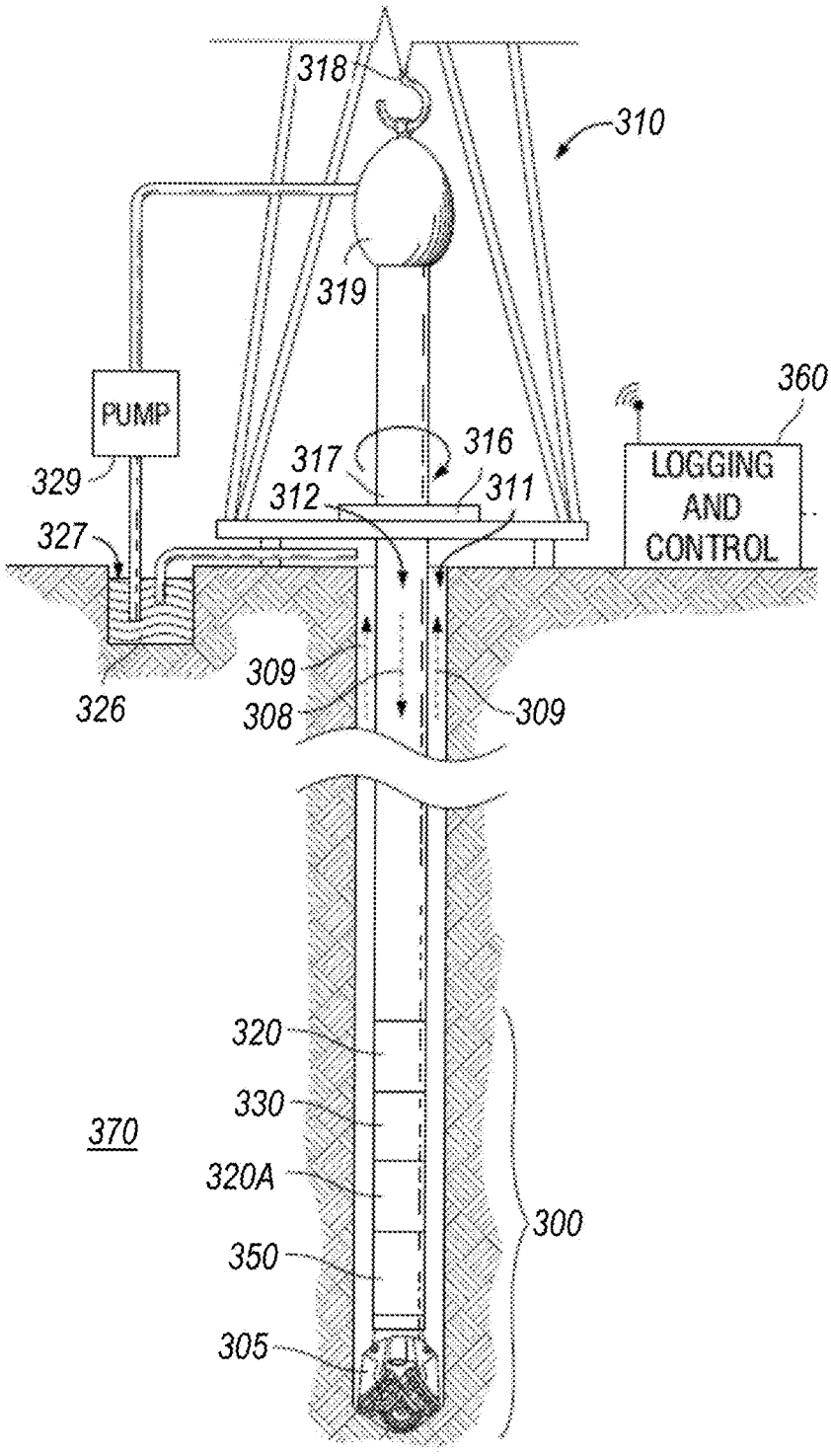
FIG. 2A is a schematic view of apparatus according to one or more aspects of the present disclosure.
Figure 2B:
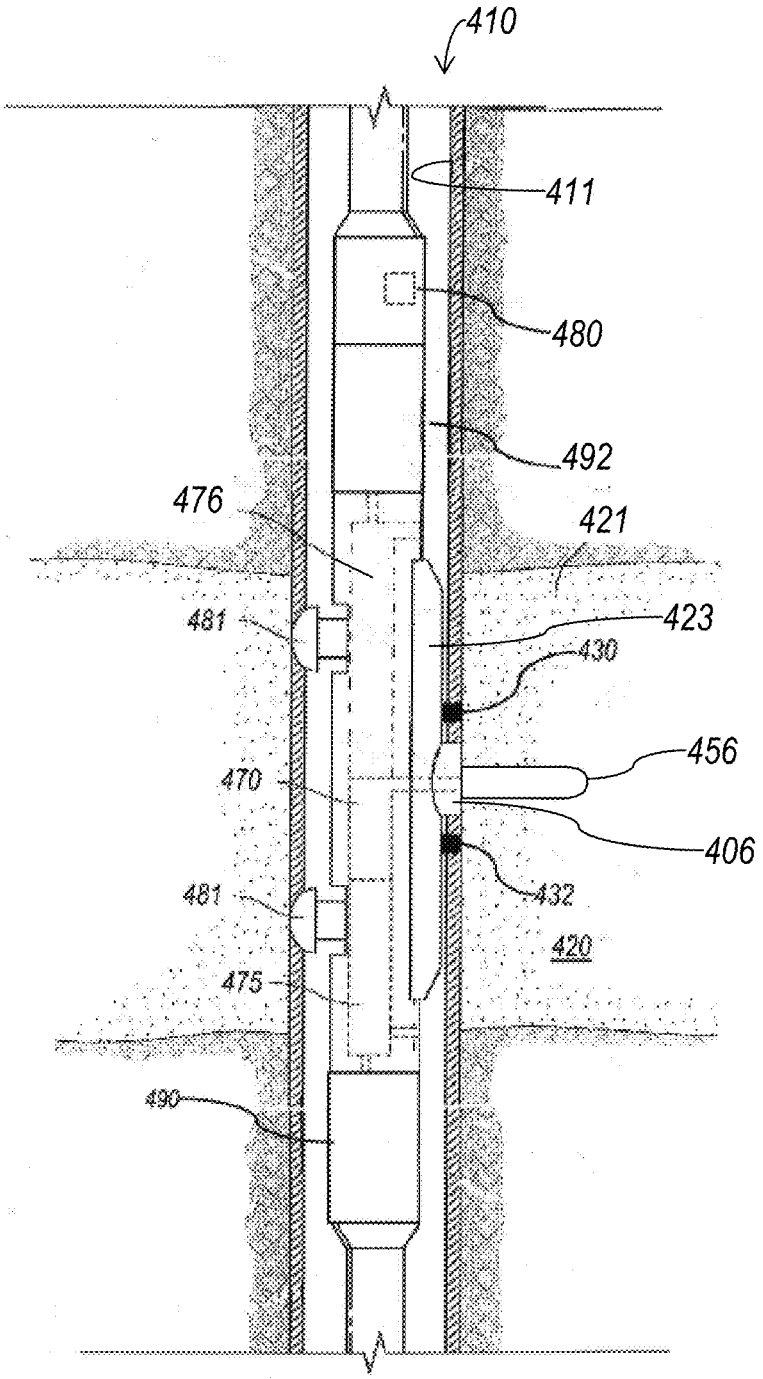
FIG. 2B is a schematic view of apparatus according to one or more aspects of the present disclosure.

Turning to FIGS. 2A and 2B, collectively, an example well site system according to one or more aspects of the present disclosure is shown. The well site may be situated onshore (as shown) or offshore. The system may comprise one or more sampling-while drilling devices 320, 320A, 410 that may be configured to seal a portion of a wall of a wellbore 311, 411 penetrating a subsurface formation 370, 420, and form a hole 456 through the sealed portion of the wellbore wall. The sampling-while drilling device 320, 320A, 410 may be further configured to inject an injection fluid into the formation 370, 420 through the hole 456, and determine a saturation of the injection fluid in the formation by measuring a property of the formation proximate the hole 456 while maintaining the sealed portion of the wellbore wall.

Referring to FIG. 2A, the wellbore 311 may be drilled through subsurface formations by rotary drilling in a manner that is well known in the art. However, the present disclosure also contemplates others examples used in connection with directional drilling apparatus and methods.

A drill string 312 may be suspended within the wellbore 311 and may include a bottom hole assembly (BHA) 300 proximate the lower end thereof. The BHA 300 may include a drill bit 305 at its lower end. It should be noted that in some implementations, the drill bit 305 may be omitted and the bottom hole assembly 300 may be conveyed via tubing or pipe. The surface portion of the well site system may include a platform and derrick assembly 310 positioned over the wellbore 311, the assembly 310 including a rotary table 316, a kelly 317, a hook 318 and a rotary swivel 319. The drill string 312 may be rotated by the rotary table 316, which is itself operated by well known means not shown in the drawing. The rotary table 316 may engage the kelly 317 at the upper end of the drill string 312. As is well known, a top drive system (not shown) could alternatively be used instead of the kelly 317 and rotary table 316 to rotate the drill string 312 from the surface. The drill string 312 may be suspended from the hook 318. The hook 318 may be attached to a traveling block (not shown) through the kelly 317 and the rotary swivel 319, which may permit rotation of the drill string 312 relative to the hook 318.

In the example of FIG. 2A, the surface system may include drilling fluid (or mud) 326 stored in a tank or pit 327 formed at the well site. A pump 329 may deliver the drilling fluid 326 to the interior of the drill string 312 via a port in the swivel 319, causing the drilling fluid 326 to flow downwardly through the drill string 312 as indicated by the directional arrow 308. The drilling fluid 326 may exit the drill string 312 via water courses, nozzles, or jets in the drill bit 305, and then may circulate upwardly through the annulus region between the outside of the drill string and the wall of the wellbore, as indicated by the directional arrows 309. The drilling fluid 326 may lubricate the drill bit 305 and may carry formation cuttings up to the surface, whereupon the drilling fluid 326 may be cleaned and returned to the pit 327 for recirculation.

The bottom hole assembly 300 may include a logging-while-drilling (LWD) module 320, a measuring-while-drilling (MWD) module 330, a rotary-steerable directional drilling system and hydraulically operated motor 350, and the drill bit 305. The LWD module 320 may be housed in a special type of drill collar, as is known in the art, and may contain a plurality of known and/or future-developed types of well logging instruments. It will also be understood that more than one LWD module may be employed, for example, as represented at 320A (references, throughout, to a module at the position of LWD module 320 may alternatively mean a module at the position of LWD module 320A as well). The LWD module 320 may include capabilities for measuring, processing, and storing information, as well as for communicating with the MWD 330. In particular, the LWD module 320 may include a processor configured to implement one or more aspects of the methods described herein. In the present example, the LWD module 320 includes a testing-while-drilling device as will be further explained hereinafter.

The MWD module 330 may also be housed in a special type of drill collar, as is known in the art, and may contain one or more devices for measuring characteristics of the drill string and drill bit. The MWD module 330 may further include an apparatus (not shown) for generating electrical power for the downhole portion of the well site system. Such apparatus typically includes a turbine generator powered by the flow of the drilling fluid 326, it being understood that other power and/or battery systems may be used while remaining within the scope of the present disclosure. In the present example, the MWD module 330 may include one or more of the following types of measuring devices: a weight-on-bit measuring device, a torque measuring device, a vibration measuring device, a shock measuring device, a stick slip measuring device, a direction measuring device, and an inclination measuring device. Optionally, the MWD module 330 may further comprise an annular pressure sensor and/or a natural gamma ray sensor. The MWD module 330 may include capabilities for measuring, processing, and storing information, as well as for communicating with a logging and control unit 360. For example, the MWD module 330 and the logging and control unit 360 may communicate information (uplinks and/or downlinks) via mud pulse telemetry (MPT) and/or wired drill pipe (WDP) telemetry. In some cases, the logging and control unit 360 may include a controller having an interface configured to receive commands from a surface operator. Thus, commands may be sent to one or more components of the BHA 300, such as to the LWD module 320.

A testing-while-drilling device 410 (e.g., similar to the LWD tool 320 in FIG. 2A) is shown in FIG. 2B. The testing-while-drilling device 410 may be provided with a stabilizer that may include one or more blades 423 configured to engage a wall of the wellbore 411. The testing-while-drilling device 410 may be provided with a plurality of backup pistons 481 configured to assist in applying a force to push and/or move the testing-while-drilling device 410 against the wall of the wellbore 411. The configuration of the blade 423 and/or the backup pistons 481 may be of a type described, for example, in U.S. Pat. No. 7,114,562, incorporated herein by reference. However, other types of blade or piston configurations may be used to implement the testing-while-drilling device 410 within the scope of the present disclosure. A probe assembly 406 may extend from the stabilizer blade 423 of the testing-while-drilling device 410. The probe assembly 406 may be configured to selectively seal off or isolate selected portions of the wall of the wellbore 411 to fluidly couple to an adjacent formation 420. The probe assembly 406 may include a perforating mechanism (not shown in FIGS. 2A and 2B) configured to form the hole 456 through the formation 420 beyond the wall of the wellbore 411. A probe seal may be associated with the perforating mechanism and may be configured to substantially prevent movement of fluid into or out of the formation 420 other than through the hole 456. Thus, the probe seal may be configured to fluidly couple components of the testing-while-drilling device 410, such as pumps 475 and/or 476, to the adjacent formation 420 via the hole 456. Once the probe 406 fluidly couples to the adjacent formation 420, various measurements may be conducted on the adjacent formation 420. For example, a pressure parameter may be measured by performing a pretest.

The pump 476 may be used to draw subterranean formation fluid 421 from the formation 420 into the testing-while-drilling device 410 via the hole 456. The fluid may thereafter be expelled through a port into the wellbore, or it may be sent to one or more fluid collecting chambers disposed in a sample carrier module 492, which may receive and retain the formation fluid for subsequent testing at another component, the surface or a testing facility. Alternatively, the fluid sample may segregate in the sample carrier module 492. One or more segregated portions of the sampled fluid may be used as an injection fluid, as described above.

The testing-while-drilling device 410 may also be used to discharge injection fluid into the formation 420, for example, by moving the injection fluid from one or more fluid collecting chambers disposed in an injection fluid carrier module 490 using for example the pump 475. The injection fluid may be moved from the one or more fluid collecting chambers by applying hydrostatic pressure from within the wellbore to a sliding the piston disposed in the collecting chamber, in addition to or in substitution of using the pump 475. While the testing-while-drilling device 410 is depicted as having pumps 475 and 476, the testing-while-drilling device 410 may be provided with a single reversible pump.

In the illustrated example, the stabilizer blade 423 of the testing-while-drilling device 410 is provided with a plurality of sensors 430, 432 disposed adjacent to a port of the probe assembly 406. The sensors 430, 432 may be configured to determine petrophysical parameters (e.g., saturation levels) of a portion of the formation 420 proximate the probe assembly 406. For example, the sensors 430 and 432 may be configured to measure electric resistivity, dielectric constant, magnetic resonance relaxation time, nuclear radiation, and/or combinations thereof.

The testing-while-drilling device 410 may include a fluid sensing unit 470 through which the obtained fluid samples and/or injected fluids may flow, and which may be configured to measure properties of the flowing fluid. For example, the fluid sensing unit 470 may be of a type described in relation to the fluid sensing unit 220 depicted in FIG. 2. It should be appreciated that the fluid sensing unit 470 may include any combination of conventional and/or future-developed sensors within the scope of the present disclosure.

A downhole control system 480 may be configured to control the operations of the testing-while-drilling device 410. For example, the downhole control system 480 may be configured to control the extraction of fluid samples from the formation 420 and/or the injection of fluids into the formation 420, for example, via the pumping rate of the pumps 475 and/or 476. The downhole control system 480 may be further configured to control the forming of the hole 456.

The downhole control system 480 may be further configured to analyze and/or process data obtained, for example, from downhole sensors disposed in the fluid sensing unit 470 or from the sensors 430, store measurement or processed data, and/or communicate measurement or processed data to another component and/or the surface (e.g., to the logging and control unit 360 of FIG. 2A) for subsequent analysis. For example, a formation dielectric constant and/or a formation magnetic resonance relaxation time distribution measured by at least one of the sensors 430 and 432 may be processed to determine a connate fluid saturation (e.g., water, gas and/or oil) and/or an injected fluid saturation. Additionally, a formation electric resistivity measured by at least one of the sensors 430 and 432 may be correlated with the determined saturations to determine a relationship between saturation and electric resistivity of the formation. Composition data measured with the fluid sensing unit 470 and flow rate induced by the pump 475 and/or 476 may be correlated with the determined saturations to determine effective permeability curves. The logging and control unit 360 (in FIG. 2A) and/or the downhole control system 480 may include a processor configured to implement one or more aspects of the methods described herein.

While the formation tester 214 of FIG. 1, and/or the testing-while drilling device 410 of FIG. 2B are depicted with one probe assembly, multiple probes may be provided with the formation tester 214 and/or the testing-while drilling device 410 within the scope of the present disclosure. For example, probes of different inlet sizes, shapes (e.g., elongated inlets) or counts, seal shapes or counts, may be provided.

Figure 3:
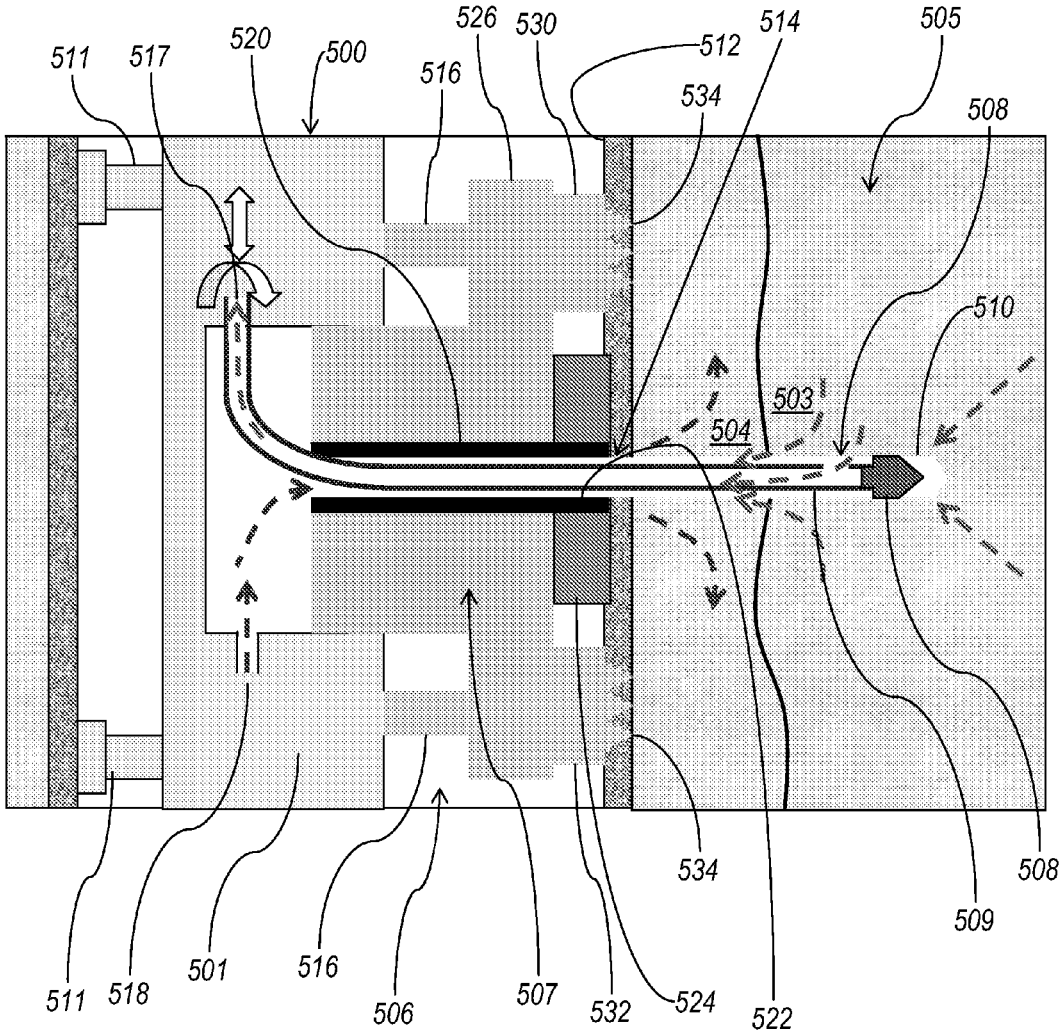
FIG. 3 is a schematic view of apparatus according to one or more aspects of the present disclosure.

Turning to FIG. 3, a formation evaluation apparatus 500 according to one or more aspects of the present application is shown. The formation evaluation apparatus 500 may be used to implement a portion of the formation tester 214 of FIG. 1 and/or the testing-while-drilling device 410 of FIG. 2B. The formation evaluation apparatus 500 may be configured to seal a portion 514 of a wall 512 of a wellbore 506 penetrating a formation 505, form a hole 510 through the sealed portion 514 of the wellbore wall 512, and measure one or more petrophysical properties of the formation 505 proximate the hole 510 while maintaining the sealed portion 514 of the wellbore wall.

For example, the formation evaluation apparatus 500 may include a housing 501 configured for conveyance within the wellbore 506. The formation evaluation apparatus 500 may be urged against the side of the wellbore wall 512 opposite a probe assembly (also referred to simply as the "probe") 507, for example, by actuating anchor pistons 511. A piston-type or other actuator 516 may be used for moving the probe 507 between a retracted position (not shown in FIG. 3) during conveyance of the housing 501 and a deployed position (shown in FIG. 3) for sealing the region 514 of the wellbore wall 512. Thus, the probe 507 may be carried by the housing 501 and may be configured, when urged against the wellbore wall 512, to seal the region 514 of the wellbore wall 512. The actuator 516 may be connected to a probe plate 526 for moving the probe plate 526 between the retracted and deployed positions, and a controllable power source (such as a hydraulic system) for extending and retracting the pistons (not shown separately). The probe 507 may comprise a seal 524, such as an elastomer ring or similar sealing element, mounted to the probe plate 526 to create the seal between the wellbore wall 512 and the region 514.

A drill may be rotated and moved longitudinally by a motor assembly (not shown). The drill may comprise a flexible drilling shaft 509 having a drill bit 508 at an end thereof. An example of the motor assembly may be found in U.S. Pat. No. 5,692,565, the disclosure of which is incorporated herein by reference. The drill may be used for penetrating the formation 505 proximate the sealed-off region 514. For example, the flexible shaft 509 may be guided through a suitably shaped tube 520 and may convey rotational and translational power to the drill bit 508 from the motor assembly. The action of the drill may result in creating the lateral bore or hole 510 extending partially through the formation 505 away from the wellbore wall 512.

The formation evaluation apparatus 500 further includes a flow line 518 extending from a fluid reservoir through a portion of the formation evaluation apparatus 500 and in fluid communication with the formation 505, through the tube 520 and out through an opening 522 of the packer 524. The fluid reservoir may be or comprise, for example, one or more fluid collecting chambers disposed in the injection fluid carrier modules 226, 228 of FIG. 1 and/or the injection fluid carrier module 490 of FIG. 2A. A pump (such as the pump 221 of FIG. 1 and/or the pump 475 of FIG. 2B) may be provided in fluid communication with the formation 505 via the tube 520 and the flow line 518. The pump may be used for pumping fluid from the reservoir into the formation 505 when desired. A sensor may be associated with the pump so that a volume of fluid pumped into the formation 505 may be monitored. However, other types of sensors configured to monitor the volume of fluid displaced into the formation 505 may be used within the scope of the present disclosure. Additionally, a fluid sensing unit (such as the fluid sensing unit 220 of FIG. 1 and/or the fluid sensing unit 470 of FIG. 2B) may be carried within the housing 501 for measuring pressure and viscosity of the fluid within the flow line 518, among other fluid properties.

The formation evaluation apparatus 500 further includes a flow line 517 extending through a portion of the tool body. The flow line 517 may be in fluid communication with an opening 508 in the shaft 509. A pump (such as the pump 231 of FIG. 1 and/or the pump 476 of FIG. 2B) may be provided in fluid communication with the formation 505 via the flow line 517. The pump may be used for pumping fluid from the formation 505 when desired. A fluid sensing unit (such as the fluid sensing unit 220 of FIG. 1 and/or the fluid sensing unit 470 of FIG. 2B) may be carried within the housing 501 for measuring composition data, viscosity, and/or pressure of the fluid within the flow line 517, among other fluid properties.

Sensors 530 and 532 may be provided on the probe plate 526 adjacent to the seal 524 and may be configured to measure one or more petrophysical properties (e.g., saturation levels) of the formation 505 proximate the hole 510 while maintaining the sealed portion 514 of the wellbore wall. For example, the sensors 530 and 532 may be extended from the housing 501 and pressed against the mud cake lining the wellbore wall 512. Pressing the sensors 530 and 532 against the wellbore wall 512 may minimize the need for correcting the measurements performed by the sensors for wellbore fluid effects. The sensors 530 and 532 may be mounted on a mechanically compliant system (not shown), such as a hydraulic cushion and/or springs. The compliant system may be configured to deform to facilitate the compression of the seal 524 and therefore insure a suitable hydraulic seal between the wellbore 506 and the sealed portion 514. The sensors 532 and 534 may be further provided with sharp edges or points 534 configured to penetrate the mud cake and make contact with the formation 505. The edges or points 534 may minimize the need for correcting the measurements performed by the sensors for mud cake effects.

The sensors 530 and/or 532 may be selected from the group consisting of electric resistivity sensors, dielectric constant sensors, magnetic resonance sensors, nuclear radiation sensors, and combinations thereof. For example, the sensors 530 and/or 532 may include electrodes for current injection into the formation or current return from the formation. Such sensors may comprise one or more arrays of electrodes provided to measure electric resistivity values associated with each of a plurality of sensing volumes of the formation proximate the hole and defined by electrode spacings or interdistances. Guard electrodes may also be provided to define the sensing volumes away from the wellbore wall 512. Alternatively, or additionally, the sensors 530 and/or 532 may include coils suitable for measuring electrical conductivity in the formation by electromagnetic induction and/or electromagnetic propagation. The sensors 530 and/or 532 may include permanent magnets and coils configured to perform nuclear magnetic resonance (NMR) analysis of the formation and fluids therein. The sensors 530 and/or 532 may include nuclear radiation detectors, such as a scintillation counter coupled to a multichannel pulse height analyzer, and may be configured to detect radiation emanating from the formation in response to a nuclear radiation source, such as a pulsed neutron source arranged to emit bursts of high energy neutrons into the formation. The radiation detected may include gamma rays resulting from interaction of the high energy neutrons with atomic nuclei in the formation. Oxygen activation and related spectra may be detected to derive a measurement related to the amount of the formation pore space that may be occupied by water, and the part that is occupied by hydrocarbons.

While the formation evaluation apparatus 500 is shown with flow lines 517 and 518, only one flow line may be provided. Further, while the flow line 518 may be used to inject fluid into the formation 505 and the flow line 517 may be used to withdraw fluid from the formation 505, both flow lines may be used to inject and/or withdraw fluid. For examples, contaminated fluid may be withdrawn via the flow 518 from a zone 504 contaminated by mud filtrate, while pristine fluid may be withdrawn via the flow line 517 from a connate zone 503. Additional flow lines and/or seals may be provided on the shaft 509, for example as described in U.S. Pat. No. 7,347,262, incorporated herein by reference.

Turning to FIGS. 4A to 4D, resistivity sensors according to one or more aspects of the present application are shown. The resistivity sensors may be associated with probe assemblies 557*a*, 557*b*, or 557*c*, and may be used to implement a portion of the formation evaluation apparatus 500 of FIG. 3. The probe assemblies of FIGS. 4A to 4D may be configured to seal a portion of a wall 562 of a wellbore penetrating a formation 555, form a hole 560 through the sealed portion of the wellbore wall by extending a bit 558*a*, 558*b*, or 558*c* into the formation 555 through the sealed portion, introduce an electrical current into the formation from the bit, and measure an electrical current of the formation while maintaining the sealed portion of the wellbore wall. Electrical current measurements may be performed while/after drilling the hole 560, and/or before, during and after injecting fluid into the formation 555 or sampling fluid from the formation 555. The current measurements may be used to determine a resistivity of the formation 555. The resistivity of the formation 555 may further be related to the relative saturation of conductive and non-conductive fluids in the pore spaces of the formations, such as by relationships well known in the art.

Figure 4A:
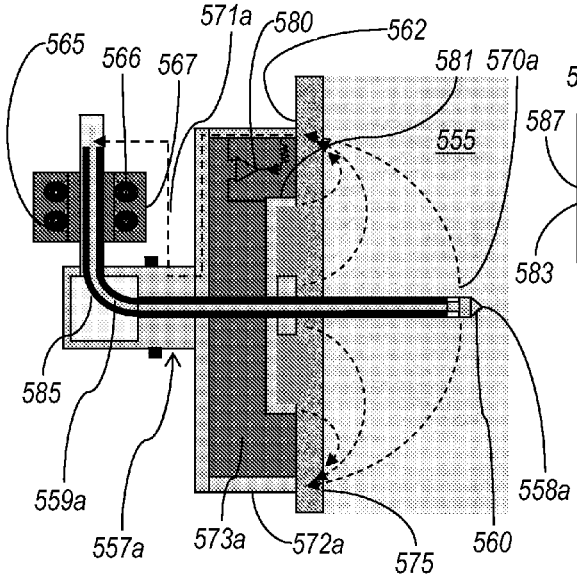
FIGS. 4A through 4D are schematic views of apparatus according to one or more aspects of the present disclosure.

Referring to FIG. 4A, electrical current may be introduced into the formation by implementing a transformer, in which the primary side comprises a transmitter toroid 565, and the secondary side comprises a single conductive loop including a flexible shaft 559*a*, the bit 558*a*, a formation path 570*a*, and a return path 571*a*. For example, the transmitter toroid 565 may comprise turns of wire wound around a toroidal core and disposed in an insulating housing 567. Electrical current may be introduced into the formation by passing an alternating driving current through the transmitter toroid 565. The driving current may induce a magnetic field in the toroidal core. The magnetic field may induce an electrical field (that is, a voltage differential related to the driving current) in the flexible shaft 559*a*. The electrical field may generate an electrical current in a conductive portion of the flexible shaft. The generated current may exit the flexible shaft and/or the bit 558*a*, perpendicularly to the conductive surfaces thereof. The generated current may be introduced into the formation 555 from the bit 558*a* and/or the shaft 559*a*, for example when the fluid present in the hole 560 is sufficiently conductive and/or when the bit 558*a* electrically couples with the formation 555. The current along the formation path 570*a* may be forced to return at an outer diameter electrode 572*a* of the probe assembly 557*a* by providing an insulating material 573*a* configured to cover an inner surface of the probe assembly 557*a*. The single conductive loop may be completed through the return path 571*a* (e.g., an insulated wire and/or a portion of the body of the probe assembly 557*a*). The flexible shaft 559*a* may be configured to provide adequate electrical contact with the return path 571*a* to complete the conductive loop.

The driving current magnitude through the transmitter toroid 565 may be measured. The driving current magnitude is related to voltage differential in the conductive portion of the flexible shaft 559*a*. A magnitude of the current generated in the conductive portion of the flexible shaft 559*a* may be measured using a measurement toroid 566 coupled to an amperemeter (not shown). The generated current magnitude may depend on the geometry of the probe assembly 557*a*, the resistivities of the formation 555, the mud cake 575, the fluid present in the hole 560, the resistance of the return path 571*a*, and the resistance of the flexible shaft 559*a*. The generated current magnitude may originate from a combination of current paths flowing from the shaft 559*a* and/or the bit 558*a* to the electrode 572*a*. However, appropriate simplifications or other modifications may be introduced to determine the resistivity of the formation 555. For example, the resistance of the return path 571*a* and/or the resistance of the flexible shaft 559*a* may be known from calibration measurements, such as may be performed in a surface laboratory. The resistance of the fluid present in the hole 560 may also be known, such as from measurements performed in a surface laboratory and/or performed in situ using a fluid sensing unit (such as the fluid sensing unit 220 of FIG. 1 and/or the fluid sensing unit 470 of FIG. 2B). The resistivities of the formation 555 and the mud cake 575 may be determined from multiple measurements associated with a plurality of sensing volumes. For example, the effective resistance between the shaft 559*a* and/or the bit 558*a* and the electrode 572*a* may be determined from driving current and generated current measurements performed at multiple extensional positions of the bit 558*a* in the hole 560 by moving the bit to different position inside the hole. The mud cake resistivity may be estimated from a measurement of the effective resistance performed with the bit in a recessed position in the hole. The formation resistivity may be determined from the estimated mud cake resistivity and a measurement of the effective resistance performed with the bit in an extended position in the hole. The resistivities of the formation 555 and the mud cake 575 may be determined by inversion techniques using measurements performed at a plurality of positions of the bit 558*a* within the hole 560.

The resistivity sensor shown in FIG. 4A may be limited in its accuracy due to the tendency for current to travel along a conductive fluid path in the hole 560 and/or along the mud cake 575 before reaching the electrode 572*a*. The foregoing may be alleviated in part by use of a current focusing technique configured to keep the voltage differential along the mud cake 575 substantially at zero. For example, the electrode 572*a* may be connected to a voltage controller 580 configured to maintain substantially zero voltage differential between the electrode 572*a* and a focusing electrode 581. Thus, the voltage differential along the mud cake 575 may be minimized, thereby forcing the formation current path 570*a* away from the wellbore wall 562 and deeper into the formation 555. Alternatively, or additionally, the outer surface of the flexible shaft 559*a* may be coated with an insulating material 585 configured to withstand the mechanical abrasion of the drilling operation. The insulating material 585 may comprise a diamond-like carbon ("DLC") coating deposited on the shaft 559*a* using a chemical vapor deposition (CVD) process. By insulating the exterior of the shaft 559*a*, the current generated in the conductive portion of the shaft may be permitted to only exit the shaft at the bit 558*a*, which may provide a laterally deeper measurement. Insulating the flexible shaft may also facilitate locating the transmitter toroid 565 and/or the measurement toroid 565 further away from the probe assembly 557*a* because the insulating outer surface 585 may prevent a short circuit between the shaft and the body of the probe assembly 557*a*.

Figure 4B:
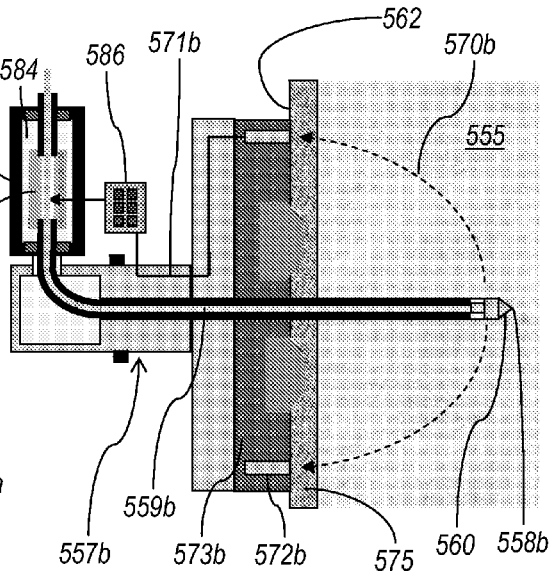

Referring to FIG. 4B, electrical current may be introduced into the formation by coupling a conductive portion of a flexible shaft 559*b* and/or the bit 558*b* to a current driver 586 (e.g., a power amplifier) via a collector 587. The collector 587 may include a slip ring 583 (e.g., a rotating electrical contact) disposed in an insulating fluid 584 (e.g., hydraulic oil). The collector 587 may be configured to insure one or more electrical contacts with the conductive portion of the flexible shaft 559*b* while allowing the flexible shaft 559*b* to rotate and/or translate therethrough for actuating the bit 558*a*. The flexible shaft 559*b* may be coated as previously described, or may alternatively be provided with one or more insulated electrical conductors therethrough connected to the bit 558*b*. Thus, electrical current may be introduced into the formation 555 from the bit 558*b*. The current may flow in the formation along a formation path 570*b* towards one or more cylindrical electrodes 572*b* disposed in an insulating material 573*b* configured to cover a surface of the probe assembly 557*b*. The electrode 572*b* is electrically coupled to the current driver 586 via a return path 571*b* (e.g., an insulated wire and/or a portion of the body of the probe assembly 557*b*).

In the electrical sensor of FIG. 4B, the flexible shaft 559*b* may be electrically insulated except at the collector 587 and at the bit 558*b*. Such isolation may facilitate the control and/or the measurement of the current introduced in the formation 555 by the current driver 586. For example, voltage differential and current across the current driver 586 may be measured by electronics coupled to the driver. The measured voltage differential and current may be used to determine the formation and mud cake resistivities, among others, for example as described in relation to FIG. 4A.

Figure 4C:
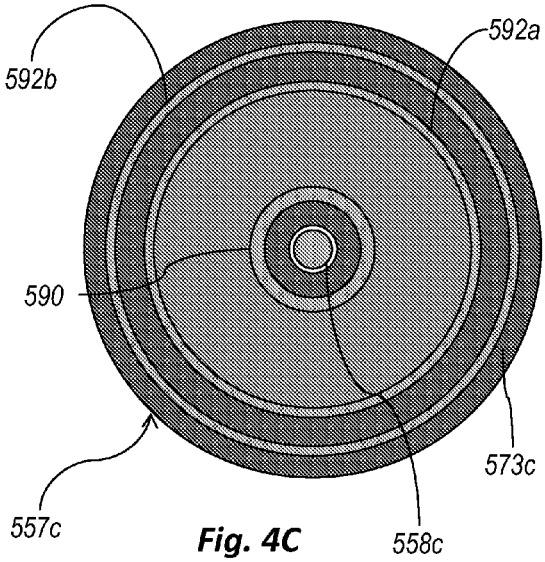
Figure 4D:
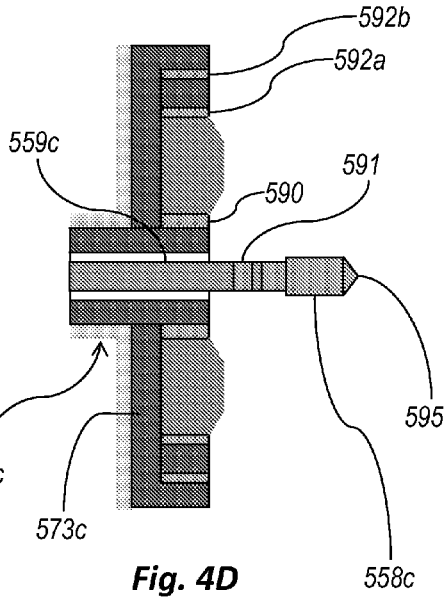

Another resistivity sensor according to one or more aspects of the present disclosure is shown schematically in FIG. 4C in frontal view and FIG. 4D in side view. The resistivity sensor of FIGS. 4C and 4D may include a current injection electrode 595, a focusing or "bucking" electrode 590, a sensing electrode 591, and a pair of voltage monitoring electrodes 592*a* and 592*b* associated with the probe assembly 557*c*, the flexible shaft 559*c* and the bit 558*c*. Placing the electrodes in a configuration as shown in or similar to FIGS. 4C and 4D may provide an enhanced sensitivity of the resistivity sensor to the resistivity in a region away from the wellbore wall 562 and/or a smaller sensitivity of the resistivity sensor to the resistivity in a region proximate the wellbore wall 562. Thus, the contribution to the sensor measurements of the mud cake resistivity and/or the fluid present in the hole 560 may be minimized.

The current injection electrode 595 may be operatively coupled to the transmitter toroid 565 of FIG. 4A via the shaft 559*c*. Alternatively, the current injection electrode 595 may be electrically coupled to the current driver 586 of FIG. 4B. Thus, an injection current $I_{A0}$ of known amplitude may be introduced into the formation from the current injection electrode 595.

The sensing electrode 591 may be configured to measure the voltage of the formation proximate the current injection electrode 595. For example, the sensing electrode 591 may be disposed on the drill shaft 559*c* adjacent the current injection electrode 595.

The focusing or bucking electrode 590 may be operatively coupled to the monitoring electrodes 592*a* and 592*b* via a voltage controller (e.g., similar to the voltage controller 580 of FIG. 4A). The voltage controller may be configured to introduce and optionally measure a focusing or bucking current $I_{A1}$ in the mud cake 575 and/or the formation 555 so that the voltage differential between the monitoring electrodes 592*a* and 592*b* may be maintained at substantially zero voltage differential.

The monitoring electrodes 592*a* and 592*b* may further be coupled to a return path (not shown) to flexible shaft 559*c* behind the transmitter toroid 565 of FIG. 4A or the current driver 586 of FIG. 4B. The probe assembly 557*c* may be provided with an insulating material 573*c* configured to cover a surface of the probe assembly 557*c*. Thus, the monitoring electrodes 592*a* and 592*b* may provide an exclusive return path for the injection current $I_{A0}$ and the focusing or bucking current $I_{A1}$.

A plurality of measurements of the injection current $I_{A0}$ and corresponding voltage differentials between the sensing electrode 591 and the pair of monitoring electrodes 592*a* and 592*b* may be performed for different positions of the bit 558*c*, up to the maximal extension of the bit 558*c* into the formation 555. For example, a first measurement may be performed when the bit 558*c* and/or the sensing electrode 591 is exposed to the mud cake 575. A second measurement may be performed when the bit 558*c* and/or the sensing electrode 591 is exposed to the formation 555, that is, when the bit 558*c* and/or the sensing electrode 591 is at least partially extended in the hole 560. Such plurality of measurements may be used to determine the mud cake resistivity and thickness and the formation resistivity, among other characteristics. In some cases, appropriate corrections for the fluid resistivity may be introduced.

The resistivity sensors shown in FIGS. 4A-4D may be modified to measure the formation resistivity in a plurality of circumferential sensing volumes or quadrants (e.g., top, bottom, left and right quadrants) around the hole 560 and/or the bit (e.g., the bit 558*c*). It should be appreciated, however, that the foregoing references to top, bottom, vertical and horizontal quadrants are for illustration purpose and are not intended in any way to limit the scope of the present disclosure. For example, the voltage monitoring electrodes (e.g., the monitoring electrodes 592*a* and 592*b*) may be segmented into a plurality of electrodes electrically insulated from each other and spanning each of a plurality of quadrants. A focusing or bucking current $I_{A1}$ may be provided between the focusing or bucking electrode (e.g., the focusing or bucking electrode 590) and a pair of monitoring electrode segments in one of the plurality of quadrants, while other monitoring electrode segments are in open circuit. The operation may be repeated for others of the plurality of quadrants. Thus, injection current values and associated voltage differential values between the bit (e.g., measured with the sensing electrode 591) and the pair of monitoring electrodes segments may be measured. The measured injection currents and voltage differentials may be used to determine formation resistivity values corresponding to different quadrants of the formation (or a resistivity image of the formation) and, in turn, fluid saturation values corresponding to different quadrants of the formation (or a saturation image).

The resistivity and/or saturation image may be used to quantify the local heterogeneity and/or anisotropy of the formation. For example, an injected fluid saturation larger in the left and right quadrants than in the top and bottom quadrants may indicate that the formation has a larger permeability in the horizontal plane than in the vertical plane. Conversely, an injected fluid saturation larger in the top and bottom quadrants than in the left and right quadrants may indicate that the formation has a lower permeability in the horizontal plane than in the vertical plane.

In the example shown in FIGS. 4C and 4D, the current injection electrode 595 comprises at least a portion of the bit 558*c*. However, the current injection electrode 595 may be implemented separate from and extendable with the bit 558*c* within the scope of the present disclosure. Further, the sensing electrode 591 may be omitted within the scope of the present disclosure. For example, the voltage differential between the sensing electrode 591 and the pair of monitoring electrodes 592*a* and 592*b* may be estimated from the driving current of the transmitter toroid 565 (in FIG. 4A) and/or from the voltage differential across the current driver 586 (in FIG. 4B). Also, the sensing electrode 591 may be used to measure the spontaneous potential with respect to a common reference point or naturally occurring voltage, in addition to or in place of the resistivity measurements. Still further, other arrangements of focusing or bucking electrodes may be used within the scope of the present disclosure, and may be derived from arrangements known by the term laterolog 3 ("LL3"), laterolog 7 ("LL7"), laterolog 8 ("LL8"), or micro-spherically focused log ("MSFL"), among others.

Turning to FIGS. 5A-5H, magnetic resonance sensors according to one or more aspects of the present application are shown. The magnetic resonance sensors may be associated with probe assemblies 600*a*, 600*b*, 600*c*, or 600*d* and may be used to implement a portion of the formation evaluation apparatus 500 of FIG. 3. The probe assemblies of FIGS. 5A-5H may be configured to seal a portion of a wall of a wellbore penetrating a formation, form a hole through the sealed portion of the wellbore wall by extending a bit 601*a*, 601*b*, 601*c*, or 601*d* into the formation through the sealed portion, induce spin precession in a portion of the formation located around the formed hole, and measure spin echoes of the portion of the formation while maintaining the sealed portion of the wellbore wall. Magnetic resonance measurements may be performed during or after drilling the hole, and/or before, during and after injecting fluid into the formation and/or sampling fluid from the formation. The magnetic resonance measurements may be used to determine a porosity of the formation, relative saturations of different fluids in the pore space of the formation and/or fluid flow rates in the formation.

The probe assemblies 600*a*, 600*b*, 600*c* or 600*d* may include a magnetic steel plate, respectively 604*a*, 604*b*, 604*c*, or 604*d*. Actuators (such as the actuator 516 of FIG. 3) may be connected to the plate for moving the plate between retracted and deployed positions. An insulating body 603*a*, 603*b*, 603*c*, or 603*d* may be attached to the magnetic steel plate. The insulating body may be made with poly-ether-ether-ketone (PEEK), or similar material. The insulating body may comprise permanent magnets or electromagnets and magnetic antennas configured to perform nuclear magnetic resonance measurements. The insulating body may be configured to facilitate the transmission of the magnetic field generated by the magnets and/or the antennas to the formation. The magnetic steel plate may be configured to reflect the magnetic field generated by the magnets and/or the antennas towards the formation and away from the wellbore. Thus, relatively high magnetic fields may be generated into the formation, thereby providing sensing volumes at relatively large lateral depth in the formation and/or relatively large measurement signals.

Figures 5A, 5B:
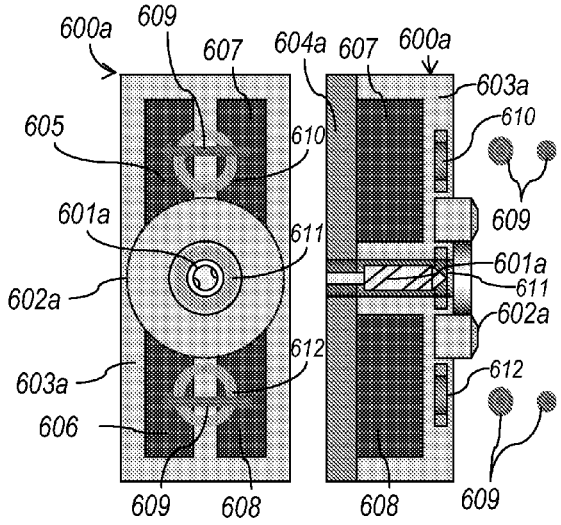
FIGS. 5A through 5H are schematic views of apparatus according to one or more aspects of the present disclosure.

In accordance with one or more aspects of the present disclosure, a nuclear magnetic resonance sensor associated with the probe assembly 600*a* is schematically shown in FIG. 5A in frontal view and FIG. 5B in side view. The nuclear magnetic resonance sensor shown in FIGS. 5A and 5B may include permanent magnets or electromagnets 605, 606, 607 and 608 whose poles may be aligned to create a static magnetic field 609 having a selected spatial distribution in the formation. For example, the permanent magnets or electromagnets 605, 606, 607 and 608 may be configured to provide a transverse orientation of the static magnetic field 609 in the formation relative to the hole to be formed by the bit 601*a*. Also, the permanent magnets or electromagnets 605, 606, 607 and 608 may be configured to provide a decreasing magnitude of the static magnetic field 609 as a function of the lateral depth into the formation. It should be appreciated that while four permanent magnets or electromagnets are shown, the permanent magnets or electromagnets may be divided, combined or connected to form any number of magnets.

Three antennas 610, 611 and 612 are shown in FIGS. 5A and 5B. The antennas 610, 611 and 612 may be coupled to electronics and configured to generate a pulsed radio frequency ("RF") magnetic field having selected spatial distribution for inducing nuclear magnetic resonance phenomena and for performing nuclear magnetic resonance measurements. For example, the antenna 610 and/or 612 may be configured to induce nuclear spin precession in a portion of the formation located around the hole formed with the bit 601*a*, and measure spin echoes of the portion of the formation while maintaining the sealed portion of the wellbore wall using a seal 602*a* (e.g., an elastomeric ring). In addition, the antenna 611 may be configured to induce spin precession in a portion of the formation corresponding to the location of the hole to be formed with the bit 601*a*, and measure spin echoes of said portion. Thus, the antenna 611 may be used to measure magnetic resonance properties of the formation prior to forming the hole with the bit 601*a*. The antenna 611 may also be used to measure magnetic resonance properties of the fluid present in the hole during sampling and/or injection after forming the hole with the bit 601*a*. Further, sensing volumes (e.g., sensing shells) having different lateral depths into the formation may be investigated by changing the frequency of the RF magnetic field generated by the antennas 610, 611 and/or 612. The sensing volumes may depend on the spatial distribution of the static magnetic field 609 in the formation. For example, the sensing volumes may correspond to regions in the formation where the static field 609 has a particular amplitude.

The radio frequency ("RF") pulse may include spin echo sequences such as Carr-Purcell-Meiboom-Gill ("CPMG") and modifications thereof to obtain quantities such as transverse relaxation time and distributions thereof, longitudinal relaxation time and distributions thereof, and diffusion constant. Various petrophysical parameters may be derived therefrom, such as formation porosity, saturation levels of one or more fluids in the pore space, and/or fluid flow rates in the formation and/or in the formed hole, among others. For example, residual oil saturations resulting from the injection of various fluids may be used to evaluate the efficacy of an enhanced oil recovery treatment by injection. Further, flow rate measurements may be performed while injecting fluid into the formation. Because the injected fluid may have a known NMR response, measurements of the flow of the injected fluid may be facilitated. In addition, relative permeabilities of fluids other than the formation fluid (such as injected fluids) may be measured using NMR techniques within the scope of the present disclosure.

Figures 5C, 5D:
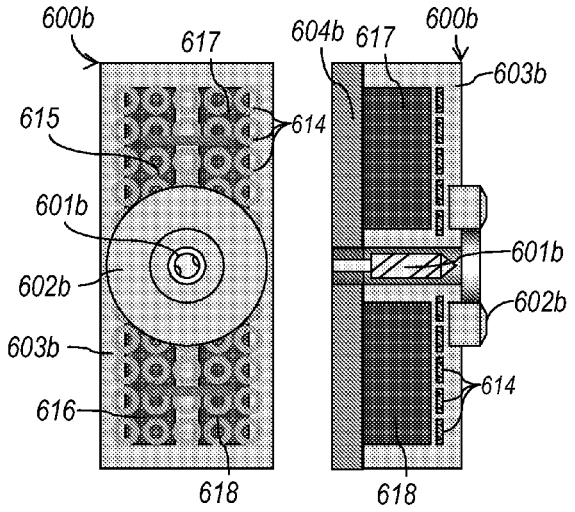

Another magnetic resonance sensor according to one or more aspects of the present disclosure is schematically shown in FIG. 5C in frontal view and FIG. 5D in side view. The nuclear magnetic resonance sensor shown in FIGS. 5C and 5D is associated with the probe assembly 600*b*. The probe assembly 600*b* may include permanent magnets or electromagnets 615, 616, 617, and 618 configured in a similar manner as the permanent magnets or electromagnets 605, 606, 607 and 608 of FIGS. 5A and 5B. The probe assembly 600*b* may be provided with a two-dimensional array 614 of antennas that may be configured to induce spin precession in a plurality of different sensing volumes of the formation located around the hole formed with the bit 601*b*, and measure spin echoes in the sensing volumes while maintaining the sealed portion of the wellbore wall using a seal 602*b*. For example, each of the plurality of sensing volumes may be indexed by a corresponding one antenna of the two-dimensional array 614. Further, lateral depths into the formation of the sensing volumes may be selectively increased or decreased by changing the frequency of the RF magnetic field generated by the antennas of the two-dimensional array 614. Thus, a three dimensional image of a formation property may be constructed.

Thus, by measuring a spatially resolved NMR image as fluid flows into or out of the formation from the probe assembly 600*b*, formation matrix heterogeneity and/or features such as fractures, among other properties, may be determined. Further, preferential flow directions of a fluid injected to displace the connate oil in the formation may be determined. For example, by comparing vertical versus horizontal flow rate, among other directional flow rates, a permeability anisotropy of the formation matrix may be determined.

Figures 5E, 5F:
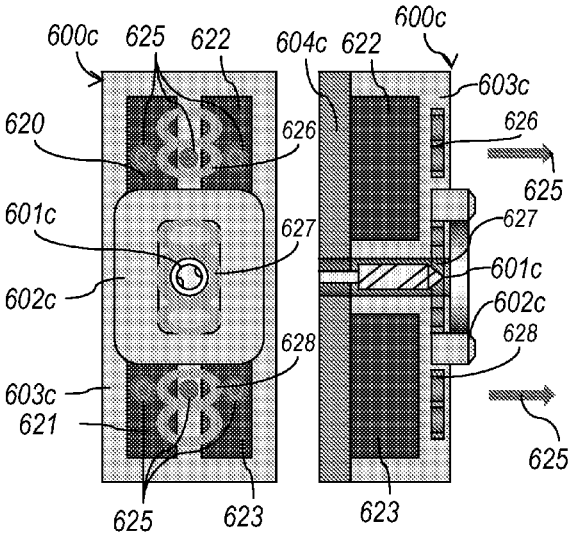

Another magnetic resonance sensor according to one or more aspects of the present disclosure is schematically shown in FIG. 5E in frontal view and FIG. 5F in side view. The nuclear magnetic resonance sensor shown in FIGS. 5E and 5F is associated with the probe assembly 600*c*. The probe assembly 600*c* may include permanent magnets or electromagnets 620, 621, 622 and 623 whose poles may be aligned to create a static magnetic field 625 having a selected spatial distribution in the formation. For example, the permanent magnets or electromagnets 620, 621, 622 and 623 may be configured to provide an orientation of the static magnetic field 609 in the formation aligned with the longitudinal axis of the hole to be formed by the bit 601*c*. Also, the permanent magnets or electromagnets 620, 621, 622 and 623 may be configured to provide a "saddle point" in the static magnetic field 625. A saddle point distribution may provide a substantially homogeneous static magnetic field at a particular lateral depth into the formation. A homogeneous static magnetic field distribution may increase the strength of the measured signals. It should be appreciated that while four permanent magnets or electromagnets are shown, the permanent magnets or electromagnets may be divided, combined or connected to form any number of magnets and/or saddle point static magnetic fields 625.

Three antennas 626, 627 and 628 are shown in FIGS. 5E and 5F. The antenna 626 and/or 628 may be configured to induce nuclear spin precession in a portion of the formation located around the hole formed with the bit 601*c*, and measure spin echoes of the portion of the formation while maintaining the sealed portion of the wellbore wall using a seal 602*c*. In addition, the antenna 627 may be configured to induce spin precession in a portion of the formation relatively closer to the location of the hole to be formed with the bit 601*c*, and measure spin echoes of said portion. Thus, the antenna 627 may be used to measure magnetic resonance properties of the formation prior to forming the hole with the bit 601*c*.

Figure 8:
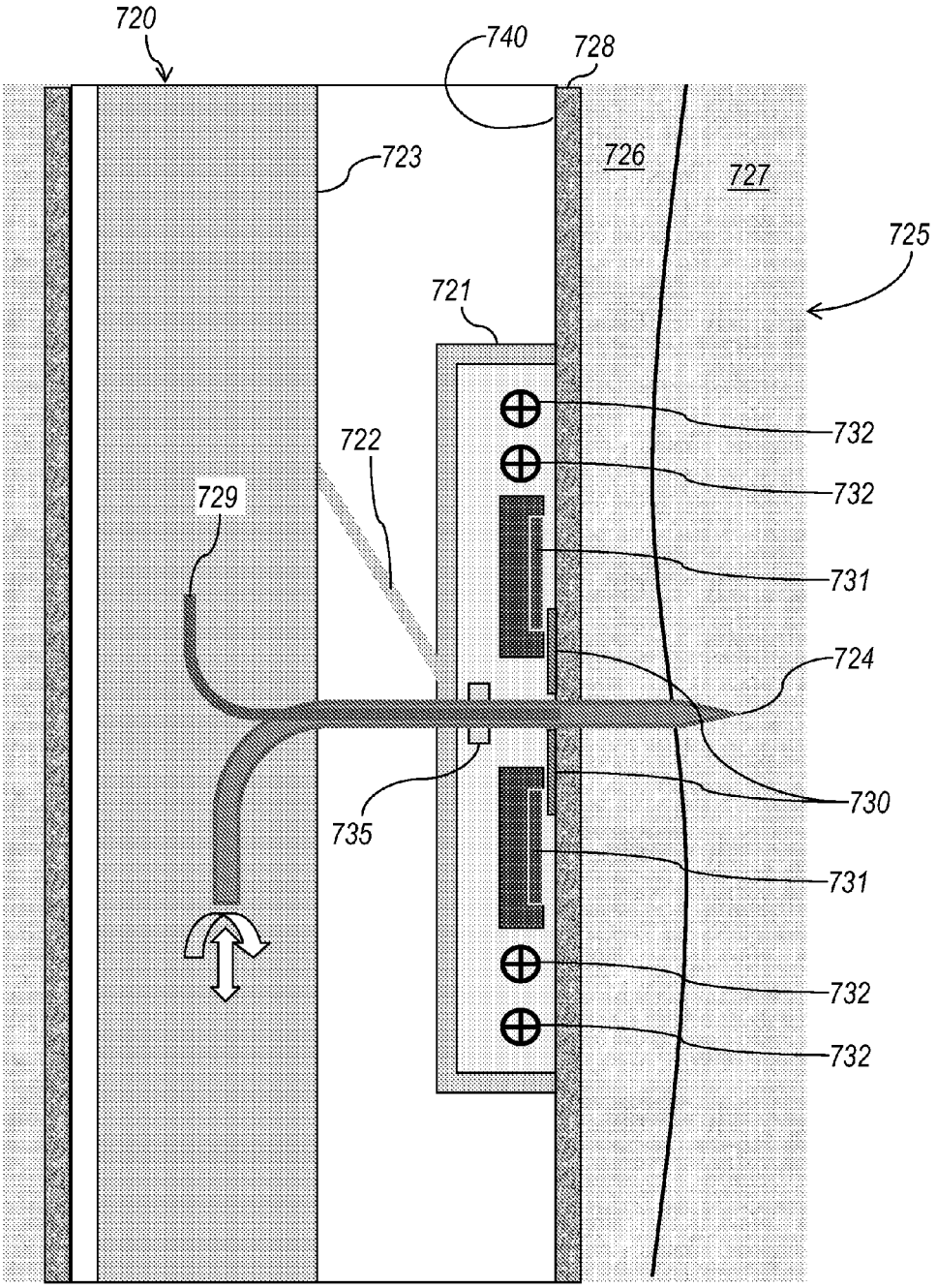
FIG. 8 is a schematic view of apparatus according to one or more aspects of the present disclosure.

As shown, the antennas 626 and 628 may be implemented with "Figure-8" coils. Figure-8 coils may produce and/or detect a magnetic field that is parallel to the surface of the coil at the "crossover" of the "8", and thus perpendicular to the static magnetic field 625 in the formation. The antenna 627 may be implemented with a "double Figure-8" coil disposed around the bit 601*c*. The double Figure-8 coil may produce and/or detect a magnetic field that is parallel to the surface of the coil in two zones corresponding to the two crossovers.

Figures 5G, 5H:
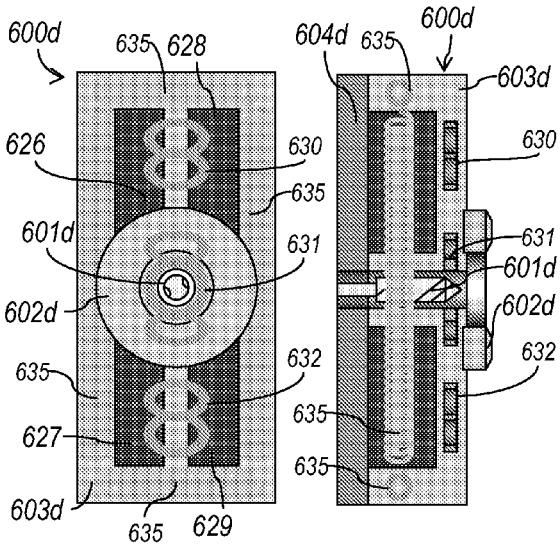

Another magnetic resonance sensor according to one or more aspects of the present disclosure is schematically shown in FIG. 5G in frontal view and FIG. 5H in side view. The nuclear magnetic resonance sensor shown in FIGS. 5G and 5H is associated with the probe assembly 600*d*. The probe assembly 600*d* may include permanent magnets or electromagnets 626, 627, 628, and 629 configured in a similar manner as the permanent magnets or electromagnets 620, 621, 622 and 623 of FIGS. 5E and 5F. The probe assembly 600*d* may be provided with antennas 630, 631 and 632 configured in a similar manner as antennas 626, 627, and 628 of FIGS. 5E and 5F. In some examples, for example in NMR formation imaging, it may be desirable to have the capability to superimpose a gradient magnetic field onto the static magnetic field. In the example of FIGS. 5G and 5H, gradient coils 635 may be configured to generate the gradient field in the formation aligned with the longitudinal axis of the hole to be formed by the bit 601*d*. The gradient field may be used to selectively increase or decrease the magnitude of the static magnetic field 625 by changing the current in the gradient coils 635. The spatial sensitivity of the NMR measurement, for example, the lateral depths into the formation of the sensing volumes associated with a given operating frequency of the antennas 630, 631, and/or 632, may be varied. Thus, a three dimensional image of a formation property may be constructed. Further, the gradient magnetic field may be used to perform flow rate measurements in the formation, for example, to construct a three dimensional image of the flow rate distribution in the formation.

Turning to FIGS. 6A-6D, electromagnetic sensors according to one or more aspects of the present application are shown. The electromagnetic sensors may be associated with the probe assemblies 650 and/or 700 and may be used to implement a portion of the formation evaluation apparatus 500 of FIG. 3. The probe assemblies of FIGS. 6A-6D may be configured to seal a portion of a wall of a wellbore penetrating a formation, form a hole through the sealed portion of the wellbore wall by extending a bit 651 and/or 701 into the formation through the sealed portion, emit an electromagnetic wave in a portion of the formation using a transmitter coil aligned with a longitudinal axis of the formed hole, and measure the electromagnetic wave using at least one receiver coil radially from the longitudinal axis of the formed hole while maintaining the sealed portion of the wellbore wall. Electromagnetic measurements may be performed while and/or after drilling the hole, and/or before, during and/or after injecting fluid into the formation and/or sampling fluid from the formation. At frequencies in the kilohertz range, the amplitude and/or phase of the measured electromagnetic wave may be largely affected by the resistivity of the formation. As is known in the art, the type of fluid in the formation pores (e.g., water or hydrocarbon) may affect the formation resistivity. Thus, the electromagnetic measurements may be used to determine relative saturations of different fluids in the pore space of the formation, among others.

The probe assemblies 650, and/or 700 may include a magnetic steel plate, respectively 652, 702. Actuators (such as the actuator 516 of FIG. 3) may be connected to the plate for moving plate between retracted and deployed positions. An insulating body 653 and/or 703 may be attached to the magnetic steel plate. The insulating body may be made with PEEK or similar material.

Figure 6A:
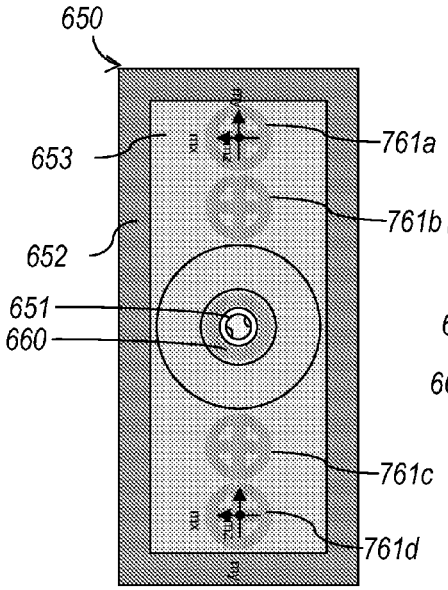
FIGS. 6A through 6D are schematic views of apparatus according to one or more aspects of the present disclosure.
Figure 6B:
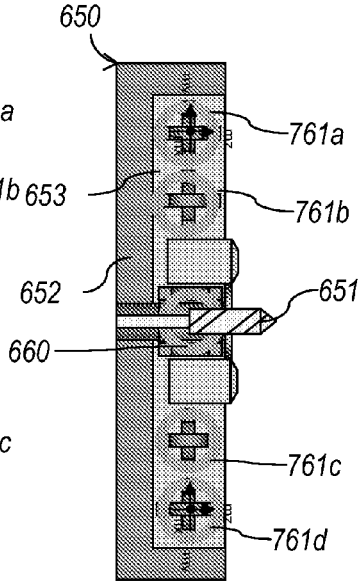
Figure 6C:
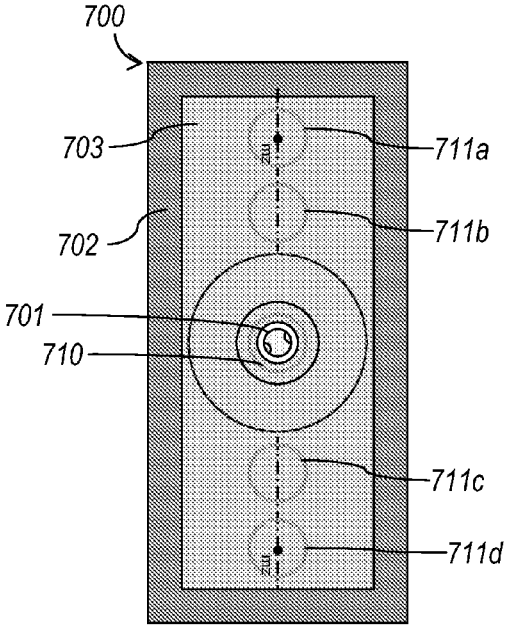
Figure 6D:
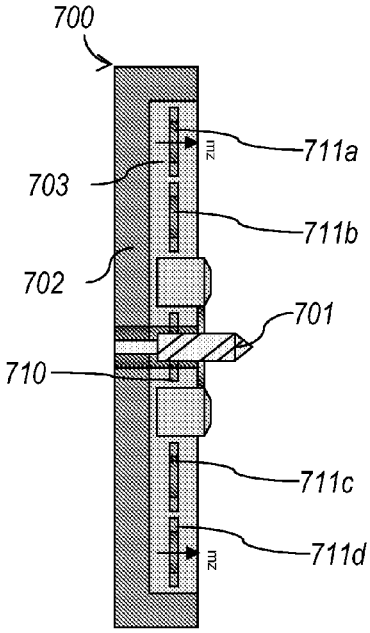

An electromagnetic transmitter antenna 660 and/or 710 may be provided in the probe assemblies 650 and 700 respectively. The transmitter antenna may be implemented with a uni-axial antenna and may include one coil (as shown in FIGS. 6C and 6D). The transmitter antenna may also be implemented with a tri-axial antenna and may include a plurality of coils (as shown in FIGS. 6A and 6B). The electromagnetic transmitter antenna 660 and 710 may be coupled to electronics (not shown) and may be configured to emit an electromagnetic wave in a portion of the formation. In FIGS. 6A-6D, the transmitter antenna may be aligned with a longitudinal axis of a hole to be formed with the bits 651 and/or 701. When the transmitter antenna is aligned with the longitudinal axis of the formed hole, the interpretation of electromagnetic measurements may be facilitated. Injection fluid (e.g., conductive injection fluid) in and/or around the formed hole and formation (e.g., hydrocarbon bearing formation) may exhibit a large resistivity contrast. The injection front may be symmetrical around the formed hole. Models describing the electromagnetic wave generated by a transmitter antenna aligned with the symmetry axis of the formed hole and/or of the injection front are known in the art, and may be used to interpret the electromagnetic measurements described below.

One or more electromagnetic receiver antennas 761*a*-761*d* and/or 711*a*-711*d* may also be provided in the probe assemblies 650 and/or 700. The receiver antennas may be implemented with uni-axial antennas and may include one coil (as shown in FIGS. 6C and 6D). The receiver antennas may also be implemented with tri-axial antennas and may include a plurality of coils (as shown in FIGS. 6A and 6B). The receiver antennas may be configured to measure the electromagnetic wave. For example, the voltage of one of the receiver antennas may be interrogated to determine a change in phase and/or a reduction in amplitude of the electromagnetic wave with respect to another of the receiver antennas and/or the transmitter antenna. In FIGS. 6A-6D, the receiver antennas may be spaced radially from the longitudinal axis of the formed hole.

An electromagnetic induction sensor according to one or more aspects of the present disclosure is schematically shown in FIG. 6A in frontal view and FIG. 6B in side view. The frequency of the driving voltage of the transmitter antenna 660 may be lower than 100 kHz (for example between 10 kHz and 50 kHz). The distance between the transmitter antenna 660 and the middle point between the receiver antennas pairs <661*a*, 661*b*> and/or <661*c*, 661*d*> may be around six inches. The distance between the receiver antennas 661*a* and 661*b* may be around one inch. The distance between the receiver antennas 661*c* and 661*d* may also be around one inch. The number of wire turns in the coils of the transmitter antenna 660 and in the coils of the receiver antennas 661*a* and 661*d* (i.e., the antennas most distant from the transmitter antenna) may be around 10. The winding direction in the coils of the bucking receiver antennas 661*b* and 661*c* (i.e., the antennas less distant from the transmitter antenna) may be reversed from the winding direction in the coils of the receiver antennas 661*a* and 661*d*. The number of wire turns in the coils of the bucking receiver antennas 661*b* and 661*c* may be adjusted to increase the sensitivity of the measurement in a desired region, for example away from the insulating body 653. All coils may have a diameter of around two centimeters. All antennas may be implemented with tri-axial antennas to enable selective orientation of the electromagnetic wave.

An electromagnetic propagation sensor according to one or more aspects of the present disclosure is schematically shown in FIG. 6C in frontal view and FIG. 6D in side view. In the example shown, the frequency of the driving voltage of the transmitter antenna 710 is higher than 100 kHz (for example between 100 kHz and 500 kHz). The distance between the transmitter antenna 710 and the middle point between the receiver antennas pairs <711*a*, 711*b*> and/or <711*c*, 711*d*> may around six inches. The distance between the receiver antennas 711*a* and 711*b* may be around one inch. The distance between the receiver antennas 711*c* and 711*d* may also be around one inch. The number of turns in all coils may be at most two. All antennas may be implemented with uni-axial antennas having dipole moments perpendicular to the plane of the probe assembly 700. However, other uni-axial antenna orientations are possible.

It should be appreciated that two dimensional arrays of receiver antennas may be implemented in the probe assemblies 650 and/or 700. By providing a two dimensional array of receiver antennas, for example similar to the antenna array 614 shown in FIGS. 5C and 5D, different sensing volumes may be investigated in the formation. For example, the two dimensional array of receiver antennas may provide measurement configurations having different spacings between transmitter and receiver(s). Thus, measurements indicative of the formation resistivity at various lateral depths may be performed. These measurements may be inverted and the effect of the filtrate invasion on the measured resistivity may be eliminated. A resistivity value representative of the injected zone beyond the zone invaded by drilling fluid may be determined. Further, a saturation level (e.g., a residual oil saturation level and/or an injection fluid saturation level) representative of the injected zone beyond the zone invaded by drilling fluid may also be determined. Furthermore, a front between immiscible fluids (e.g., between the injected fluid and the connate formation fluid) may be tracked as the volume of the injected fluid in (or out by reversing the pump) the formation is altered. Saturation changes with time as a function of injection pressure may be used to determine effective permeabilities of connate formation fluid and/or injected fluid in the formation.

Figure 7:
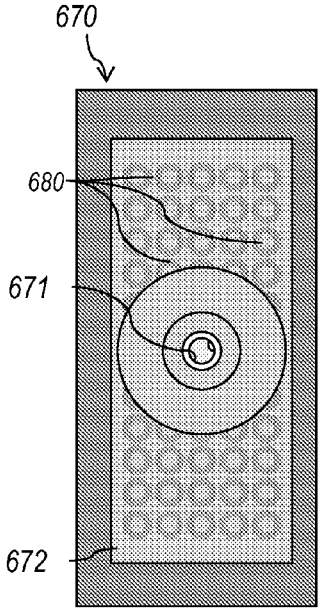
FIG. 7 is a schematic view of apparatus according to one or more aspects of the present disclosure.

Turning to FIG. 7, a dielectric sensor according to one or more aspects of the present application is shown. The dielectric sensor may be associated with the probe assembly 670 and may be used to implement a portion of the formation evaluation apparatus 500 of FIG. 3. The probe assembly of FIG. 7 may be configured to seal a portion of a wall of a wellbore penetrating a formation, form a hole through the sealed portion of the wellbore wall by extending a bit 671 into the formation through the sealed portion, and image the formation while maintaining the sealed portion of the wellbore wall. Formation electric permittivity measurements (or dielectric measurements) may be performed while and/or after drilling the hole, and/or before, during and/or after injecting fluid into the formation and/or sampling fluid from the formation. At high frequencies, for example, in the megahertz to gigahertz range, the amplitude and/or phase of electromagnetic waves may be largely affected by the formation electric permittivity (or dielectric constant of the formation). As is known in the art, formation electric permittivity has been shown to provide, in combination with a porosity measurement, a hydrocarbon and/or water saturation measurement which is independent of saturation and cementation exponents (i.e., Archie parameters) utilized with resistivity sensors.

A two dimensional array 680 of antennas, for example embedded in an insulating body 672, may be implemented to determine a three dimensional permittivity image. By sequencing the antennas that are transmitting and/or receiving electromagnetic waves in the formation, measurements obtained with different transmitter/receiver spacings may be performed, among other effects of the measurement geometry. Also, different sensing volumes of the formation may be investigated. Thus, a three dimensional image of the hydrocarbon and/or water saturation levels in the formation may be constructed. A plurality of images may be constructed for a plurality of volumes of injected fluid discharged into and/or volume of fluid withdrawn from the formation.

Resistivity sensors such as shown in FIGS. 4A-4D, magnetic resonance sensors such as shown in FIGS. 5A-5H, electromagnetic sensors such as shown in FIGS. 6A-6D, and/or dielectric sensors such as shown in FIG. 7 may be associated with a single probe assembly or pad. The sensor(s) may be configured to measure petrophysical parameters of similar sensing volumes of the formation. For example, a sensor combination proximate an injection and/or sampling port may permit the measurement of the porosity of the formation, the measurement of connate and/or injection fluids saturation levels in the formation, as well as the resistivity of the formation. Thus, a plurality of saturations levels (e.g., injected fluid saturation levels in the formation pores) corresponding to each one of a plurality of injected fluid volumes may be determined. Further, a plurality of resistivity values corresponding to each one of the plurality of injected fluid volumes may be also be determined. Still further, a relationship between the determined saturation and an electric resistivity of the formation may be determined, such as saturation and cementation exponents for Archie's equation. Examples of sensors that may be used to determine formation porosity include NMR sensors and nuclear radiation sensors, among others. Examples of sensors that may be used to determine saturation levels include NMR sensors and dielectric sensors, among others. Examples of sensors that may be used to determine formation resistivity include galvanic sensors, induction sensors, and propagation sensors, among others.

Turning to FIG. 8, a formation evaluation apparatus 720 according to one or more aspects of the present application is shown. The formation evaluation apparatus 720 may provide a sensor combination proximate an injection and/or sampling port. The sensors may be configured to perform porosity, saturation and/or resistivity measurements while maintaining the sealed portion 514 of the wellbore wall.

The apparatus 720 may include a pad 721 mounted on an extension arm 722 affixed to a body 723 of the formation evaluation apparatus 720. The extension arm 722 may be configured to extend the pad 721 against a wellbore wall 740. The pad 721 may be provided with an elastomeric ring 730 configured to seal against the wellbore wall 740 and facilitating hydraulic communication between the formation evaluation apparatus 720 and a formation of interest 725. An extendable bit 724 may be configured to form a hole through a mud cake 728 lining the wellbore wall 740 and several inches into the formation 725, for example beyond a damaged and/or invaded zone 726 and into a pristine zone 727 of the formation 725. A flow line 729 may be used to inject fluids into or withdraw fluid from the formation 725.

Tri-axial antennas 732 may be provided in or on the extendable pad 721, disposed for example on two opposite sides of a shaft coupled to the bit 724 and the flow line 729. A coil of one of the tri-axial antennas may be used as a transmitter, and coils of the other tri-axial antennas may be used as receivers. Alternatively, or additionally, a toroid 735 (such as may be similar to the transmitter toroid 565 of FIG. 4A) may be used as a transmitter and coils of the tri-axial antennas 732 may be used as receivers. By passing alternating current or various forms of switched current through the transmitter coils and/or the toroid 735, and detecting voltages induced in one or more receiver coils, measurements related to the formation resistivity may be derived. For example, a method for measuring formation properties utilizing fluid injection in the formation that may be used in conjunction with the extendable pad 721 may combine tri-axial induction response and a toroidal excitation response. The transmitter coils and/or the toroid 735 may be driven at various frequencies so that the measurements at these frequencies may be inverted to produce a resistivity image of the formation in the injection zone.

In addition, NMR sensors 731 may be disposed in or on the extendable pad 721. The NMR sensors 731 may be configured to investigate a sensing volume in the vicinity of the hole formed by the bit 724. Using one or more of the sensors 731, one or more of the diffusion distribution D, the polarization relaxation distribution T1 and the precession relaxation distribution T2 may be acquired. The acquired NMR measurements may be used to determine formation porosity and injected fluid saturation levels, for example using D-T2 distributions. Thus, the NMR measurements may provide injected fluid saturation measurements independent from the formation resistivity. Also, by performing NMR measurements corresponding to different volumes and/or pressures of injected fluid, effective permeabilities of the formation may be determined.

It should be appreciated that other sensor combinations may be used within the scope of the present disclosure. For example, the antennas of the magnetic resonance sensors of FIGS. 5A-5H may also be used for electromagnetic propagation measurements, such as by using frequency ranges for driving the coils sufficiently lower than the Larmor frequency. Thus, the sensors of FIGS. 5A-5H may be used to implement a sensor assembly capable of combining NMR measurements and resistivity measurements. Further, micro-sensors (not shown) may be provided on the bit 724, and may be configured to measure formation properties.

Figure 9A:
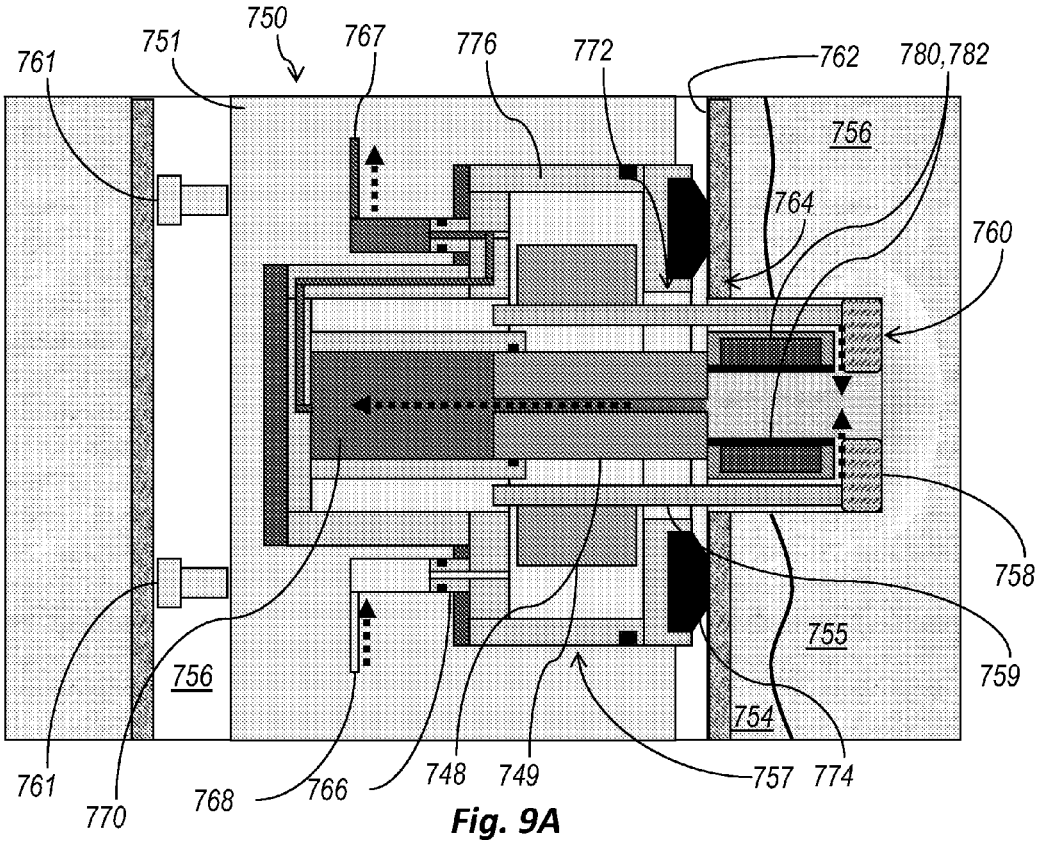
FIGS. 9A and 9B are schematic views of apparatus according to one or more aspects of the present disclosure.

Turning to FIG. 9A, a formation evaluation apparatus 750 according to one or more aspects of the present application is shown. The formation evaluation apparatus 750 may be used to implement a portion of the formation tester 214 of FIG. 1 and/or the sampling-while drilling device 410 of FIG. 2B. The formation evaluation apparatus 750 may be configured to seal a portion 764 of a wall 762 of a wellbore 756 penetrating a formation 755, form a hollow cylindrical hole 760 through the sealed portion 764 of the wellbore wall, and measure one or more petrophysical properties of the formation 755 proximate the hole 760 while maintaining the sealed portion 764 of the wellbore wall.

For example, the formation evaluation apparatus 750 may include a housing 751 configured for conveyance within the wellbore 756. The formation evaluation apparatus 750 may be urged against the side of the wellbore wall 762 opposite a core assembly 757, for example, by actuating anchor pistons 761. A piston-type or other actuator 766 may be used for moving the core assembly 757 between a retracted position (not shown in FIG. 9A) during conveyance of the housing 751 and a deployed position (shown in FIG. 9A) for sealing the region 764 of the wellbore wall 762. Thus, the core assembly 757 may be carried by the housing 751 and may be configured, when urged against the wellbore wall 762, to seal the region 764 of the wellbore wall 762. The actuator 766 may be connected to a coring housing 776 for moving the coring housing 776 between the retracted and deployed positions, and a controllable power source (such as a hydraulic system) for extending and retracting the pistons (not shown separately). The coring assembly 757 may include a seal 774, such as an elastomer ring or similar sealing element, mounted to the coring housing 776 to facilitate creating the seal between the wellbore wall 762 and the region 764.

A drill may be rotated and moved longitudinally by a motor assembly 749. The drill may comprise a coring shaft 759 having a coring bit 758 at an end thereof. An example motor assembly may be found in U.S. Pat. No. 6,371,221, the disclosure of which is incorporated herein by reference. The drill may be used for penetrating the formation 755 proximate the sealed-off region 764. The action of the drill may result in creating the lateral bore 760 extending partially through the formation 755 away from the wellbore wall 762.

The formation evaluation apparatus 750 may further include a flow line 768 extending from a fluid reservoir through a portion of the formation evaluation apparatus 750 and in fluid communication with the formation 755 through an opening 772 of the coring housing 776. The fluid reservoir may be or comprise one or more fluid collecting chambers disposed in the injection fluid carrier modules 226, 228 of FIG. 1 and/or the injection fluid carrier module 490 of FIG. 2A. A pump (such as the pump 221 of FIG. 1 and/or the pump 475 of FIG. 2B) may be provided in fluid communication with the formation 755 via the flow line 768. The pump may be used for pumping fluid from the reservoir into the formation 755. A sensor may be associated with the pump so that a volume of fluid pumped into the formation 755 may be monitored. However, other types of sensors configured to monitor the volume of fluid displaced into the formation 755 may be used within the scope of the present disclosure. Additionally, a fluid sensing unit (such as the fluid sensing unit 220 of FIG. 1 and/or the fluid sensing unit 470 of FIG. 2B) may be carried within the housing 751 for measuring pressure and viscosity of the fluid within the flow line 768, among other fluid properties.

The formation evaluation apparatus 750 further includes a flow line 767 extending through a portion of the tool body. The flow line 767 may be fluidly communicating with an extendable tube 770. A pump (such as the pump 231 of FIG. 1 and/or the pump 476 of FIG. 2B) may be provided in fluid communication with the formation 755 via the flow line 767. The pump may be used for pumping fluid from the formation 755 when desired. A fluid sensing unit (such as the fluid sensing unit 220 of FIG. 1 and/or the fluid sensing unit 470 of FIG. 2B) may be carried within the housing 751 for measuring composition data, viscosity, and/or pressure of the fluid within the flow line 767, among other fluid properties.

A non-rotating sleeve 748 may be provided in the shaft 759. The non-rotating sleeve may be configured to translate with the shaft 759. However, the rotation of the non-rotating sleeve 748 may be uncoupled from the rotation of the shaft 759. An example of such uncoupled sleeve may be found in U.S. Pat. No. 7,431,107, incorporated herein by reference. The uncoupled sleeve may be configured to sever and capture a formation core sample 747 therein.

Sensors 780 and 782 may be provided on the non-rotating sleeve 748 adjacent to the bit 758 and may be configured to measure one or more petrophysical properties (e.g., saturation levels) of the formation 755 while maintaining the sealed portion 764 of the wellbore wall. The sensors 780 and/or 782 may include one or more of electric resistivity sensors, dielectric constant sensors, magnetic resonance sensors, nuclear radiation sensors, and/or combinations thereof. For example, the sensors 780 and/or 782 may include electrodes for current injection into the formation or current return from the formation. Alternatively, or additionally, the sensors 780 and/or 782 may include coils suitable for measuring electrical conductivity in the formation by electromagnetic induction and/or electromagnetic propagation. The sensors 780 and/or 782 may include permanent magnets and coils configured to perform NMR analysis of the formation and/or fluids therein.

While the formation evaluation apparatus 750 is shown with flow lines 767 and 768, only one flow line may be provided. Further, while the flow line 768 may be used to inject fluid into the formation 755 and the flow line 767 may be used to withdraw fluid from the formation 755, both flow lines may be used to inject and/or withdraw fluid. For example, contaminated fluid may be withdrawn via the flow 768 from a zone 754 contaminated by mud filtrate, while pristine fluid may be withdrawn via the flow line 767 from a connate zone 756.

Figure 9B:
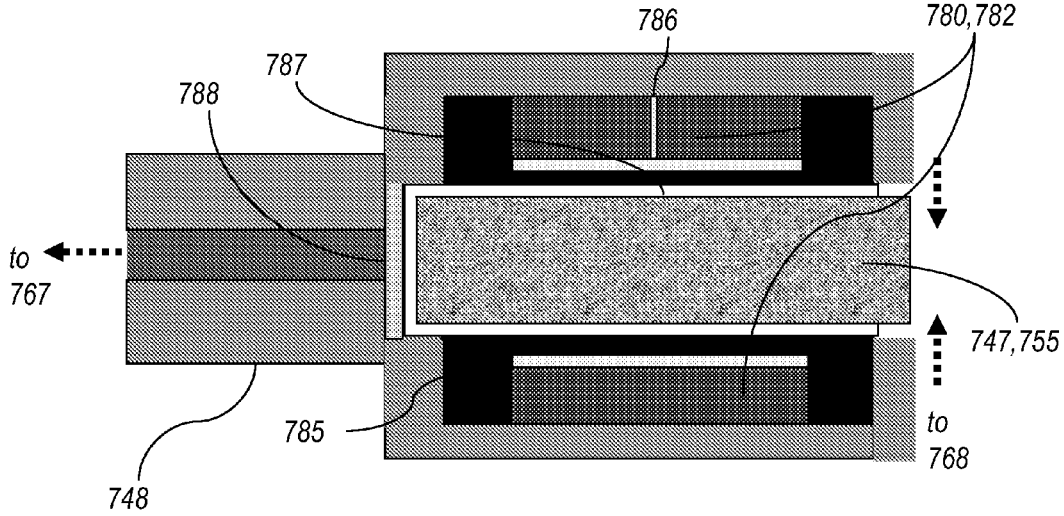

Referring to FIG. 9B, a portion of the formation evaluation apparatus 750 is shown. The non-rotating sleeve 748 may be provided with an inflatable sealing sleeve 785, similar to a Hassler sleeve, for example made with Viton. The inflatable sealing sleeve 785 may be configured to prevent fluid from bypassing the formation 755 and/or the core sample 747. A control flow line 786 may be connected to a hydraulic fluid reservoir. The control flow line pressure may be reduced (e.g., below wellbore pressure) to cause the sealing sleeve 785 to be pulled open and thus reduce friction as the formation 755 and/or the core sample 747 is being inserted into the non-rotating sleeve 748. Conversely, the control flow line pressure may be increased (e.g., above wellbore and formation pressure) to cause the sealing sleeve 785 to compress and seal around the formation 755 and/or the core sample 747. Cleaning of the inflatable sealing sleeve 785 may be performed by retracting the inflatable sealing sleeve 785 and circulating fluid from the flow line 768 to the flow line 767 or vice versa.

The non-rotating sleeve 748 may optionally be provided with a porous disk 788 to facilitate fluid flow from and/or into the flow line 767. Further, the non-rotating sleeve 748 may be provided with a hydrophilic or hydrophobic membrane 787. The membrane 787 may be used to perform in situ capillary pressure measurement. For example, using a hydrophilic membrane, the formation 755 and/or the core sample 747 may be first flushed with formation hydrocarbon (e.g., oil) by appropriate operation of flow lines 767 and/or 768. Then, the formation 755 and/or the core sample 747 may be injected with water and/or brine to increase water and/or brine saturation in stage until the irreducible saturation is achieved. The differential pressure across the formation 755 and/or the core sample 747 may be measured using a differential pressure gauge (not shown) between the flow lines 767 and 768 as a function of the water and/or brine saturation in formation 755 and/or the core sample 747. Thus, a portion of a capillary pressure curve can be constructed. Alternately, a hydrophobic membrane may be used and the formation 755 and/or the core sample 747 may be injected with hydrocarbon fluid (e.g., oil) to increase hydrocarbon saturation in stage until the residual saturation is achieved. Thus, another portion of a capillary pressure curve can be constructed.

Figure 10A:
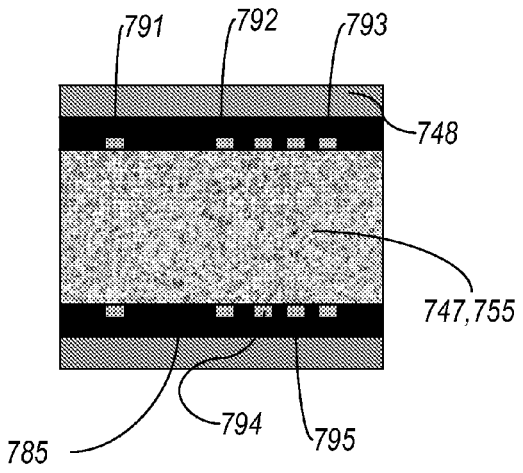
FIGS. 10A-10C are schematic views of apparatus according to one or more aspects of the present disclosure.
Figure 10B:
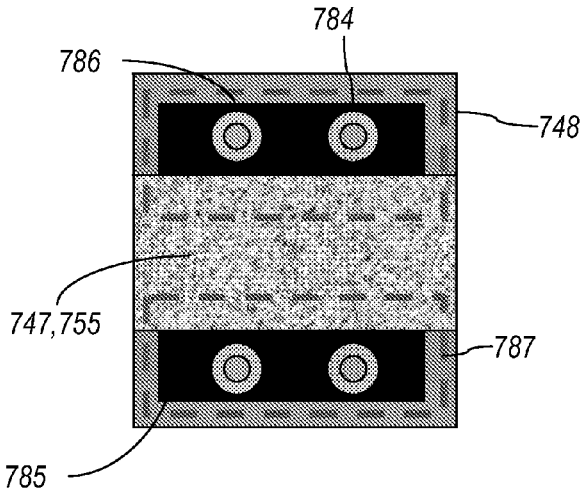
Figure 10C:
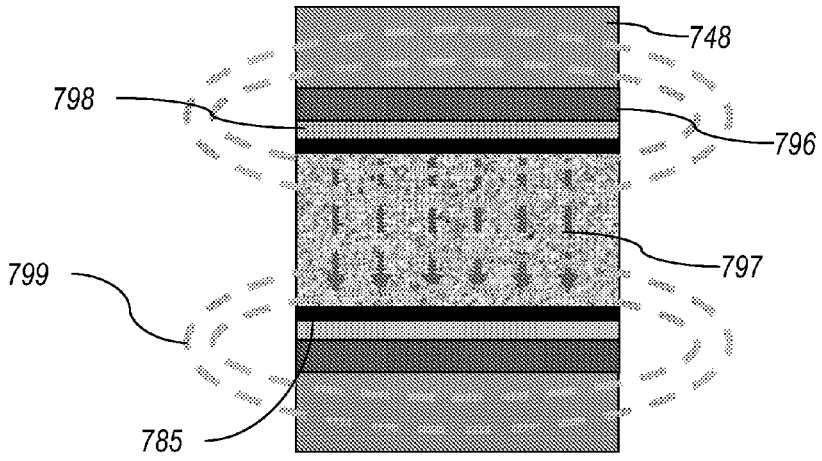

Turning to FIGS. 10A-10C, sensors according to one or more aspects of the present disclosure are shown. The sensor of FIGS. 10A-10C may be used to implement the sensors 780 and/or 782 of FIGS. 9A and 9B. For example, a resistivity sensor and an NMR sensor may be used to implement the sensors 780 and/or 782 of FIGS. 9A and 9B. Thus, a relationship between saturation determined from NMR measurements, porosity determined from NMR measurements, and resistivity may be derived as saturation levels in the formation 755 and/or the core 747 are altered. For example, one or more of the Archie's equation cementation and saturation exponents may be inverted. Further, it should be appreciated that sensors of FIGS. 10A-10C are movable with the bit 758 of FIG. 9A. Thus, measurements on different portions of the formation 755 and/or the core 747 may be performed.

Referring to FIG. 10A, a resistivity sensor may include current injection and collection electrodes, 792 and 793 respectively. A voltage differential may be measured between monitoring electrodes 794 and 795. A guard electrode 792 may be held at the same potential as the current injection electrode 792 and may be used to focus current towards the current collection electrode 793.

Referring to FIG. 10B, another resistivity sensor may include a transmitter toroid 784 and a measurement toroid 786. The transmitter toroid 784 may be used to induce an electric field such as the electric field line 787 in the formation 755 and/or the core 747. The electric field lines may return via a portion of the non-rotating sleeve 748 (e.g., made with magnetic steel). The measurement toroid 786 may be used to determine the current in the formation 755 and/or the core 747 generated by the electric field lines such as 787.

Referring to FIG. 10C, a magnetic resonance sensor may include permanent or electro magnets 796 and a solenoid 798. The permanent or electro magnet 796 may be configured to generate a homogenous magnetic field 797 in the formation 755 and/or the core 747. The solenoid 798 may be configured to generate a pulsed radio frequency magnetic field 799 having selected spatial distribution for inducing nuclear magnetic resonance phenomena and for performing nuclear magnetic resonance measurements.

Figure 11:
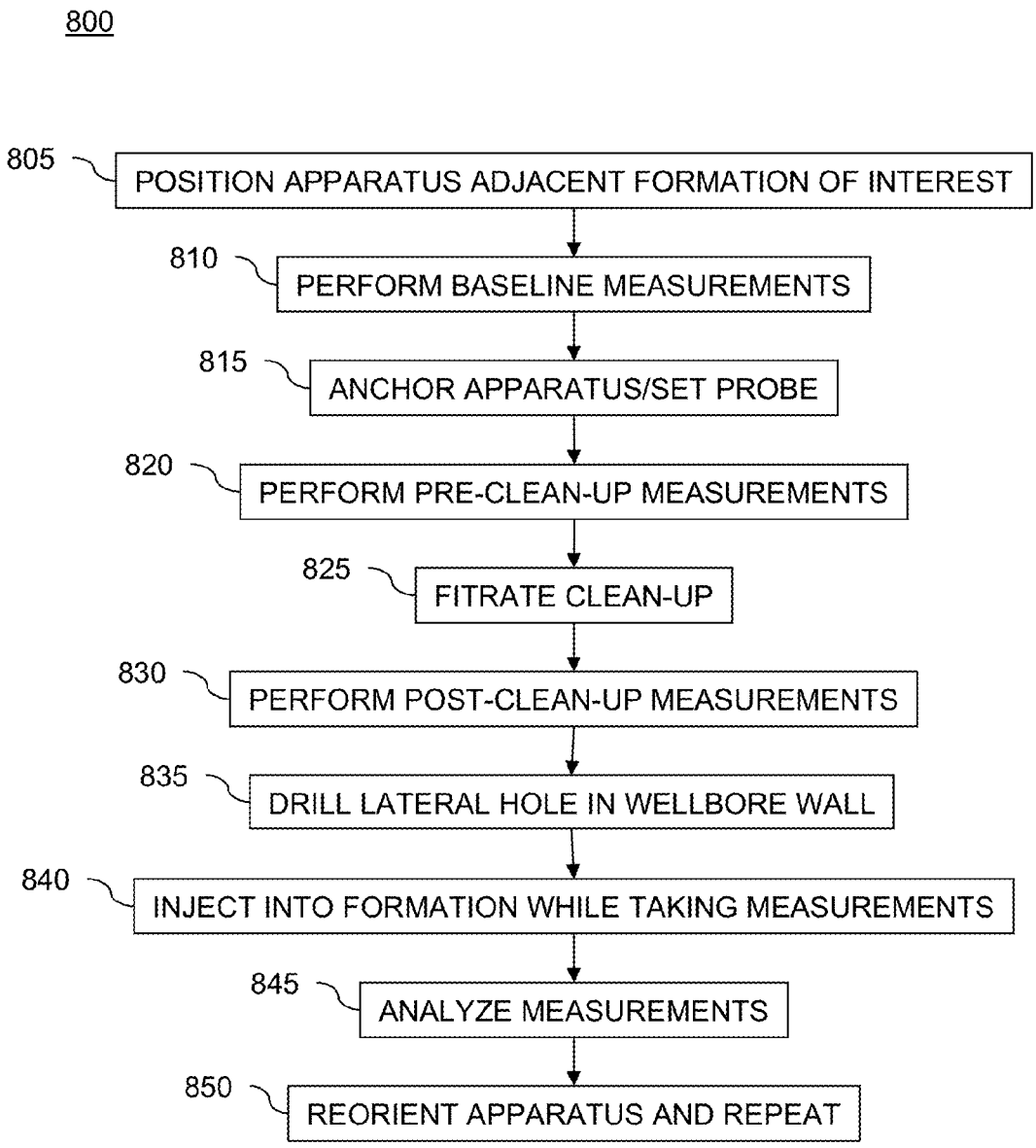
FIG. 11 is a flow chart of at least a portion of a method according to one or more aspects of the present disclosure.

Referring to FIG. 11, illustrated is a flow-chart diagram of at least a portion of a method 800 according to one or more aspects of the present disclosure. The method 800 may be performed using apparatus within the scope of the present disclosure and/or otherwise in conjunction with the operation of apparatus within the scope of the present disclosure. It should be appreciated that the order of execution of the steps of the method 800 may be changed and/or some of the steps described may be combined, divided, rearranged, omitted, eliminated and/or implemented in other ways within the scope of the present disclosure.

The method 800 may include a step 805 comprising moving the apparatus along a wellbore penetrating subsurface formations and/or orient the apparatus to a position adjacent a selected formation portion. The formation portion may be selected based on measurements such as resistivity images of the formation wall as is known in the art.

In optional step 810, one or more measurements may be performed to establish a baseline measurement in the wellbore fluid. For example, the measurements may be performed when the probe of the apparatus is in a retracted position and may communicate with the fluid in the wellbore. The measurement(s) may be used to provide an estimate of wellbore fluid resistivity, viscosity and/or other wellbore fluid properties. The measurement(s) may alternatively, or additionally, be used to calibrate the sensors of the apparatus for pressure and/or temperature effects.

In subsequent step 815, the apparatus is anchored and/or set. For example, the probe of the apparatus may articulate out from the apparatus to compress and seal against the wellbore wall, establishing a hydraulic seal with the formation. Thus, a portion of a wall of a wellbore penetrating the formation may be sealed.

In optional step 820, one or more measurements may be performed on the formation, such as to provide a porosity value and/or a permeability value (e.g., using NMR measurements), and possibly fluid saturation values in the invaded zone.

In step 825, the apparatus may be used to pump fluid from the formation into the apparatus, which may facilitate removal of filtrate from the formation near the probe. For example, pump fluid from the formation into the apparatus may involve withdrawing, via a first flow line (e.g., the flow line 518 in FIG. 3 and/or the flow line 768 in FIG. 9B), a first fluid from a zone contaminated by mud filtrate; and withdrawing, via a second flow line (e.g., the flow line 517 in FIG. 3 and/or the flow line 767 in FIG. 9B), a second fluid from a connate zone. A property of the withdrawn fluid may be measured for example using a fluid sensing unit coupled to the first or second flow line or other sensors such as the sensors 780 or 782 in FIG. 9A. The measurement(s) may be used to provide an estimate of formation fluid resistivity, viscosity and/or other formation fluid properties. One or more fluid samples may be collected in chambers for subsequent analysis.

In step 830, one or more measurements may be acquired to provide fluid saturations and/or other petrophysical data after the filtrate has been cleaned-up in a zone close to the probe and replaced by formation fluid. This data may be representative of the petrophysical characteristics of the reservoir in its original or un-invaded state.

In step 835, a drill may be used to form a lateral hole in the wellbore wall, wherein the lateral hole is sealed from communication with the wellbore other than through the probe. While forming the hole, the pressure at the sealed portion of the wellbore wall may be maintained below the formation pressure. This may facilitate the evacuation of cuttings, mud or other particles from the drilled hole. This may reduce the risk of mud or solid particles penetrating the drilled formation. This may facilitate fluid injectivity to the desired lateral depth in the formation. Formation evaluation (such as resistivity measurements) may be performed at a plurality of lateral depths by drilling the lateral hole further into the formation and repeating any testing. This may ensure that the lateral hole is extended beyond the invaded zone of the formation.

In step 840, a fluid may be injected into the formation. The fluid may be provided in collecting chambers conveyed by the apparatus. The collecting chambers may be filled with the fluid at the surface, prior to lowering the apparatus in the wellbore. Alternatively, the fluid may be collected downhole, for example, from a formation penetrated by the wellbore, segregated in the apparatus and injected into the formation. The fluid may comprise fresh water, brine or hydrocarbon, completion fluid, other fluid formulated to modify the property of the formation fluid (such as its viscosity) and/or the formation rock (such as its wettability), or mixtures thereof in predetermined fractions. While injecting fluid from the apparatus into the formation, any or all of the above-described petrophysical parameters (such as injected fluid saturation levels and/or flow rates) may be determined. The petrophysical parameters may be determined by measuring one or more properties of the formation proximate the hole while maintaining the sealed portion of the wellbore wall. Also, both the injection pressure and an injected volume of the injection fluid may be monitored contemporarily to injecting fluid into the formation.

Subsequent step 845 may comprise analyzing the measurements performed at step 840 and/or previous measurements performed at step 810, 820 and/or 830.

For example, using the examples described herein, and/or others within the scope of the present disclosure, it may be possible to monitor changes in fluid saturation of the formation in three dimensions and/or to monitor the injected fluid front.

By measuring fluid injection pressure, injected fluid viscosity and flow rate at step 840, it may be possible at step 845 to determine a relative permeability curve of an injected fluid. Relative permeability can be plotted as a function of fluid saturations in the formation, for example as illustrated in the example graph of FIG. 12. Thus, in situ determinations of relative permeability curves of fluids in the formation can be made. The steps 840 and 845 may be repeated with different injection fluids, such as oil, water and gas, as desired. Thus, residual saturations (such as the residual oil saturation "SOR" which is the amount of oil remaining in the pore space after flushing with the water or the irreducible water saturation "SWIR" which is the amount of water remaining in the pore space after flushing with oil) may also be determined at step 845. Also, step 840 may be repeated to inject chemicals such as enhanced oil recovery fluids (e.g., solvent, steam, carbon dioxide, and/or surfactants, among others) from the apparatus. Thus, changes of the relative permeability and/or residual saturation of one or more of the fluids caused by the injected chemical may be monitored. Also, fluorinated compounds may be injected to measure the formation permeability.

Figure 13:
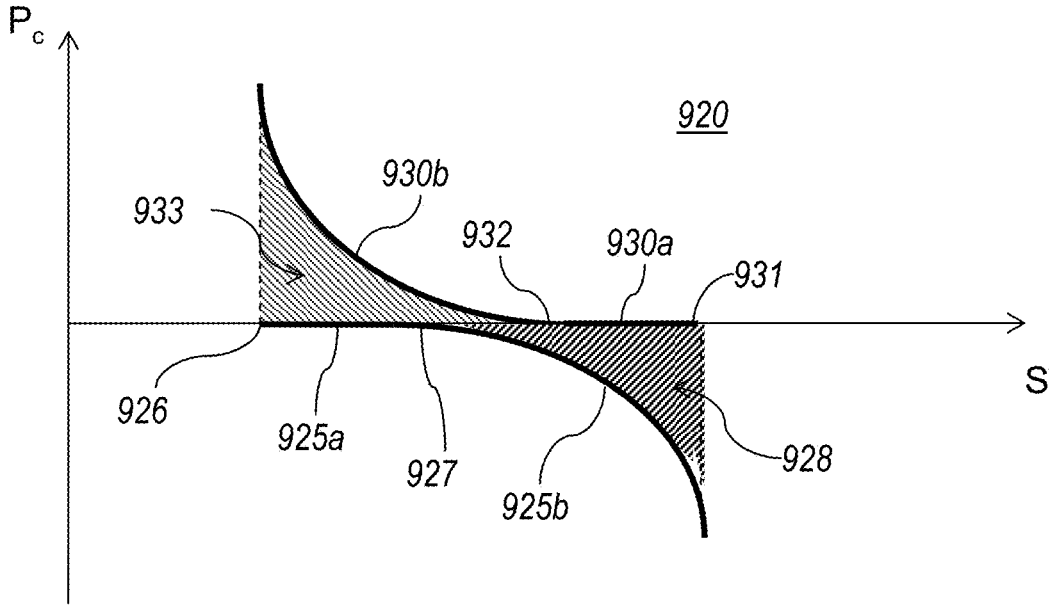
FIG. 13 is an example graph of drainage and imbibitions curves according to one or more aspects of the present disclosure.

By measuring differential pressure across a hydrophilic or hydrophobic membrane (such as membrane 787 in FIG. 9B) during fluid imbibitions and/or drainage at step 840, it may be possible at step 845 to determine capillary pressure curve, for example as illustrated in the example graph of FIG. 13. A wettability index may then be determined, for example using the modified Amott/USBM technique. Step 840 may be repeated to inject chemicals (such as detergents) to change the wettability of the formation rock and quantify a resulting change of wettability at step 845.

Figure 14:
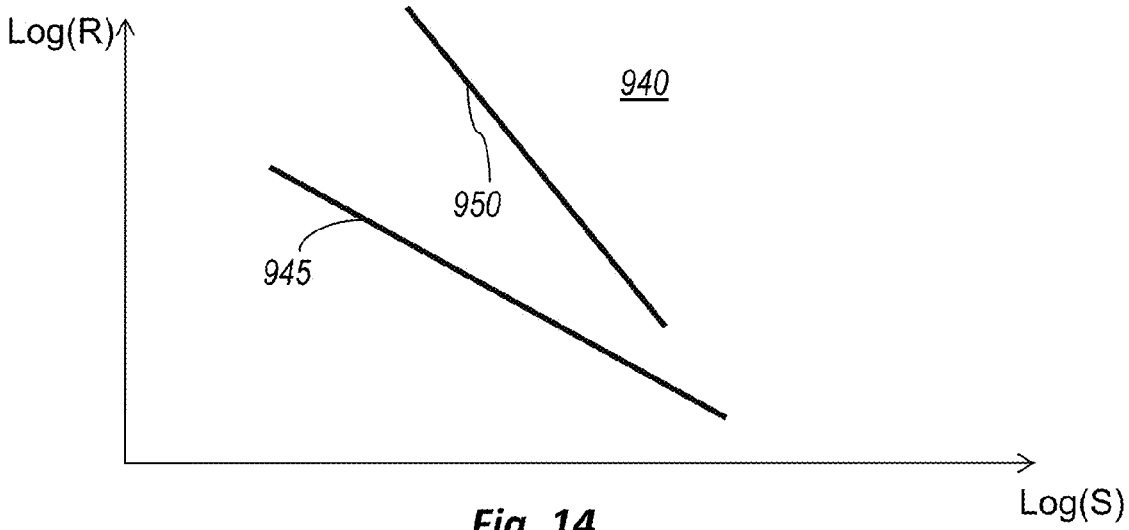
FIG. 14 is an example graph of electric resistivity versus saturation curves according to one or more aspects of the present disclosure.

As mentioned before, the resistivity measurements and the fluid saturation measurements may be combined at step 845 to form saturation versus electric resistivity curves such as illustrated in the example graph of FIG. 14. The formed curves may be used to estimate one or more of the saturation and cementation exponents of the Archie's equation or other equation such as the connectivity equation discussed in "A quantitative Model for the Effect of Wettability on the Conductivity of Porous Rocks" by B. Montaron, SPE 105041, March 2007. Thus, a relationship between the determined saturation and an electric resistivity of the formation may be determined. The Archie's equation or the connectivity equation may then be used to convert resistivity measurements into fluid saturations in other zone of the formation. Further, the parameters of the Archie's equation (such as the saturation exponent) may be used to determine a wettability parameter of the formation.

In optional step 850, the probe is retracted and the apparatus may be rotated and/or moved to the next station to iterate one or more of steps 810-845. For example, results obtained for different orientations at a single or multiple stations can be compared to identify discrepancies which may be indicative of rock heterogeneity, rock anisotropy, and/or micro-fractures having a preferential direction, among other uses.

Figure 12:
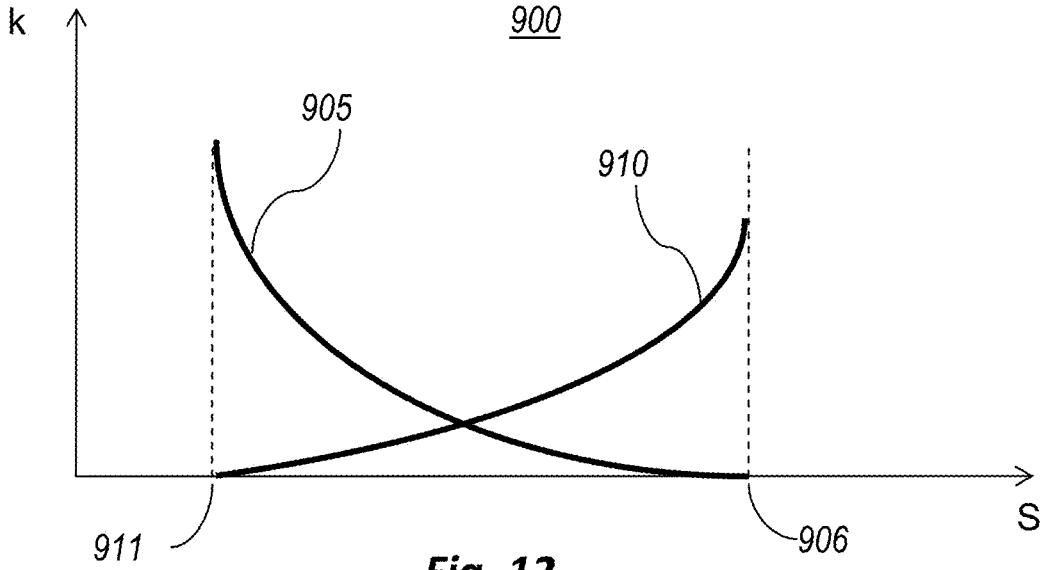
FIG. 12 is an example graph of effective permeability curves according to one or more aspects of the present disclosure.

Referring to FIG. 12, an example graph 900 depicts effective permeability (k) curves as a function of saturation (S). Effective permeability curves, such as shown in the graph 900, may be determined using apparatus and/or methods within the scope of the present disclosure. For example, an oil effective permeability curve 905 and a water (or brine) effective permeability curve 910 may be determined as a function of water (or brine) saturation. Water saturation may be measured in a portion of the formation while water saturation is increased by injection. Water and/or oil effective permeabilities may be determined from one or more of successive saturation images of the portion of the formation, flow rate measurements in the apparatus flow lines and/or in the portion of the formation, pressure measurements in the apparatus flow lines, formation pressure, and/or viscosity values of oil and water, among others. Also, irreducible water saturation points 911 and/or one minus residual oil saturation point 906 may be determined.

Referring to FIG. 13, an example graph 920 depicts capillary pressure ($P_c$) curves as a function of saturation (S). Capillary pressure curves, such as shown in the graph 920, may be determined using apparatus and/or methods within the scope of the present disclosure. For example, an imbibition curve having a spontaneous imbibitions portion 925*a* and a forced imbibitions portion 925*b* may be determined as a function of water (or brine) saturation. A portion of formation may have an initial water (or brine) saturation indicated by point 926, for example the irreducible water saturation. When placed in contact with water (or brine) at formation pressure, the water (or brine) saturation in the portion of the formation may increase to a level indicated by point 927. By injecting water (or brine) at a pressure differential Pc across a hydrophilic membrane surrounding the portion of the formation, and measuring the resulting water (or brine) saturation, the forced imbibition curve 925*b* may be determined. Alternatively or additionally, a drainage curve having a spontaneous drainage portion 930*a* and a forced drainage portion 930*b* may be determined as a function of water (or brine) saturation. A portion of formation may have an initial water (or brine) saturation indicated by point 931, for example one minus the residual oil saturation. When placed in contact with oil at formation pressure, the water (or brine) saturation in the portion of the formation may decrease to a level indicated by point 932. By injecting oil at a pressure differential Pc across a hydrophobic membrane surrounding the portion of the formation, and measuring the resulting water (or brine) saturation, the forced drainage curve 930*b* may be determined. An area above the imbibitions curve 928 and/or an area 933 below the drainage cure may further be determined. Wettability indices may be derived from the saturations points 926, 927, 931 and 932, and/or the areas 928 and 933, as is known in the art.

Referring to FIG. 14, an example graph 940 of electric resistivity R versus saturation S curves 945 and 950 corresponding to two different formations is shown. Electric resistivity versus saturation curves, such as shown in the graph 940, may be determined using the apparatus and/or the method within the scope of the present disclosure. For example, one or more of the curves 945 and 950 may be fitted to a mathematical model, expressing a relationship between the determined saturation and an electric resistivity of the formation. Parameters of the mathematical model, such as the critical water saturation and/or the saturation exponent may be related to the proportion of the oil-wet pores of the formation rock and/or the formation rock wettability (see for example "Relationship Between the Archie Saturation Exponent and Wettability" by E. C Donaldson and T. K. Siddiqui, SPE 16790, pp 359-362, September 1989).

Figure 15:
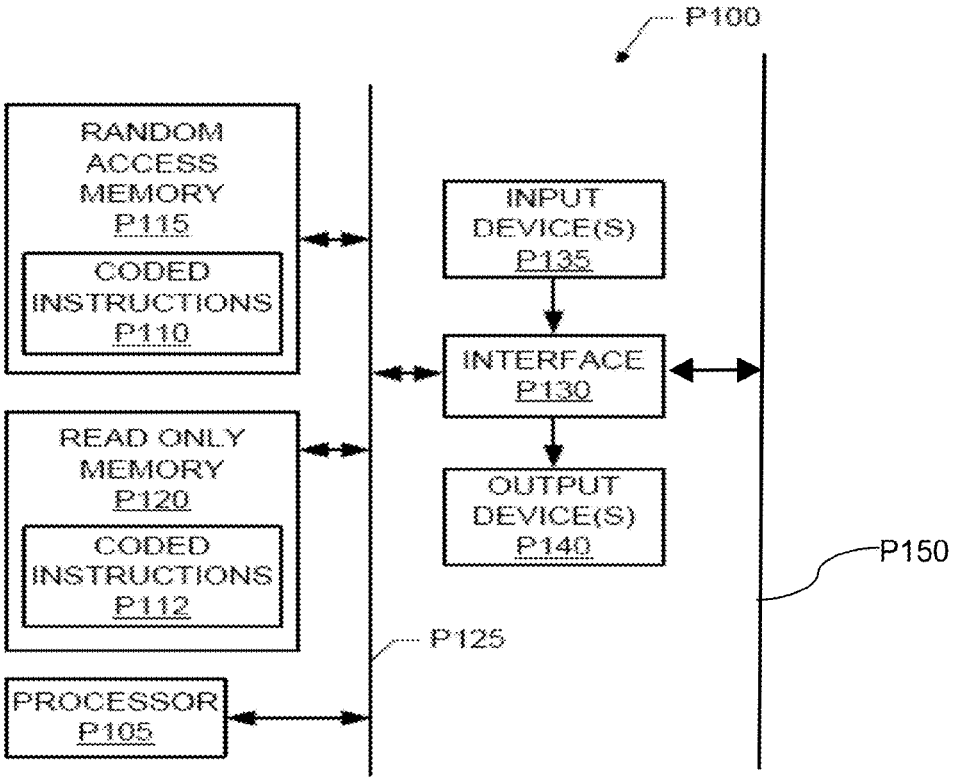
FIG. 15 is a schematic view of at least a portion of a computing system according to one or more aspects of the present disclosure.

FIG. 15 is a schematic view of at least a portion of an example computing system P100 that may be programmed to carry out all or a portion of the example method 800 of FIG. 11 and/or other methods within the scope of the present disclosure. The computing system P100 may be used to implement all or a portion of the electronics and processing system 206 of FIG. 1, the downhole control system 212 of FIG. 1, the logging and control unit 360 of FIG. 2A, the downhole control system 480 of FIG. 2B, and/or other control means within the scope of the present disclosure. The computing system P100 shown in FIG. 15 may be used to implement surface components (e.g., components located at the Earth's surface) and/or downhole components (e.g., components located in a downhole tool) of a distributed computing system.

The computing system P100 may include at least one general-purpose programmable processor P105. The processor P105 may be any type of processing unit, such as a processor core, a processor, a microcontroller, etc. The processor P105 may execute coded instructions P110 and/or P112 present in main memory of the processor P105 (e.g., within a RAM P115 and/or a ROM P120). When executed, the coded instructions P110 and/or P112 may cause the formation tester 214 of FIG. 1, the testing while drilling device 410 of FIG. 2B, the formation evaluation apparatus 500 of FIG. 3, the formation evaluation apparatus 720 of FIG. 8, and/or the formation evaluation apparatus 750 of FIG. 9A, to perform at least a portion of the method 800 of FIG. 11, among other operations.

The processor P105 may be in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown). The memory P115, P120 may be used to store, for example, measured formation properties (e.g., formation resistivity), petrophysical parameters (e.g., saturation levels, wettability), injection volumes and/or pressures.

The computing system P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The example input device P135 may be used to, for example, collect data from the sensors contemplated in FIGS. 1-10. The example output device P140 may be used to, for example, display, print and/or store on a removable storage media one or more of measured formation properties (e.g., formation resistivity values or images), petrophysical parameters (e.g., saturation levels or images, wettability), injection volumes and/or pressures. Further, the interface circuit P130 may be connected to a telemetry system P150, including, for example, the multiconductor cable 204 of FIG. 1, the mud pulse telemetry (MPT) and/or the wired drill pipe (WDP) telemetry system of FIG. 2A. The telemetry system P150 may be used to transmit measurement data, processed data and/or instructions, among other things, between the surface and downhole components of the distributed computing system.

In view of all of the above and the figures, those skilled in the art should readily recognize that the present disclosure introduces a method of subsurface formation evaluation comprising sealing a portion of a wall of a wellbore penetrating the formation, forming a hole through the sealed portion of the wellbore wall, injecting an injection fluid into the formation through the hole, and determining a saturation of the injection fluid in the formation by measuring a property of the formation proximate the hole while maintaining the sealed portion of the wellbore wall. The method may further comprise measuring at least one of a discharge pressure and a discharged volume of the injection fluid. The method may further comprise determining a relationship between the determined saturation and an electric resistivity of the formation. The method may further comprise estimating a wettability parameter of the formation based on the determined relationship. The method may further comprise withdrawing a fluid from the formation through the hole. Withdrawing a fluid from the formation may comprise: withdrawing, via a first flow line, a first fluid from a zone contaminated by mud filtrate; and withdrawing, via a second flow line, a second fluid from a connate zone. The method may further comprise measuring a property of the withdrawn fluid. The method may further comprise determining a relative permeability of the formation based on the measured property of the withdrawn fluid. The measured formation property may be selected from the group consisting of electric resistivity, dielectric constant, magnetic resonance relaxation time, nuclear radiation, and combinations thereof. Forming the hole may comprise extending a bit into the formation. The method may further comprise introducing an electrical current into the formation from the bit, and wherein measuring the property of the formation comprises measuring a return electrical current. The method may further comprise measuring a plurality of property values associated with each of a plurality of sensing volumes of the formation proximate the hole.

The present disclosure also introduces a method of subsurface formation evaluation comprising sealing a portion of a wall of a wellbore penetrating the formation, forming a hole through the sealed portion of the wellbore wall by extending a bit into the formation through the sealed portion, introducing an electrical current into the formation from the bit, and measuring an electrical current of the formation while maintaining the sealed portion of the wellbore wall. Such method may further comprise determining a property of the formation, wherein the formation property is selected from the group consisting of electric resistivity, dielectric constant, magnetic resonance relaxation time, nuclear radiation, and combinations thereof. Such method may further comprise extending the bit into the formation at a plurality of lateral depths and measuring the electrical current of the formation at the plurality of lateral depths.

The present disclosure also introduces a subsurface formation evaluation apparatus comprising means for sealing a portion of a wall of a wellbore penetrating the formation, means for forming a hole through the sealed portion of the wellbore wall, means for injecting an injection fluid into the formation through the hole, and means for determining a saturation of the injection fluid in the formation based on a property of the formation measured proximate the hole while maintaining the sealed portion of the wellbore wall. The apparatus may further comprise: means for determining a relationship between the determined saturation and an electric resistivity of the formation; and means for estimating a wettability parameter of the formation based on the determined relationship. The measured formation property may be selected from the group consisting of electric resistivity, dielectric constant, magnetic resonance relaxation time, nuclear radiation, and combinations thereof. The hole forming means may comprise means for extending a bit into the formation. The apparatus may further comprise means for introducing an electrical current into the formation from the bit, and the measured formation property may comprise a return electrical current. The apparatus may further comprise means for measuring a plurality of property values associated with each of a plurality of sensing volumes of the formation proximate the hole.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method of subsurface formation evaluation, comprising:

sealing a portion of a wall of a wellbore penetrating the formation;

forming a hole through the sealed portion of the wellbore wall;

injecting an injection fluid into the formation through the hole; and determining a saturation of the injection fluid in the formation by measuring a property of the formation proximate the hole while maintaining the sealed portion of the wellbore wall, wherein the forming the hole comprises extending a bit into the formation and introducing an electrical current into the formation from the bit, and wherein measuring the property of the formation comprises measuring a return electrical current.

2. The method of claim 1 further comprising measuring at least one of an injection pressure and an injected volume of the injection fluid.

3. The method of claim 1 further comprising determining a relationship between the determined saturation and an electric resistivity of the formation.

4. The method of claim 3 further comprising estimating a wettability parameter of the formation based on the determined relationship.

5. The method of claim 1, further comprising withdrawing a fluid from the formation through the hole.

6. The method of claim 5 wherein withdrawing a fluid from the formation comprises:

withdrawing, via a first flow line, a first fluid from a zone contaminated by mud filtrate; and withdrawing, via a second flow line, a second fluid from a connate zone.

7. The method of claim 5 further comprising measuring a property of the withdrawn fluid.

8. The method of claim 7 further comprising determining relative permeability of the formation based on the measured property of the withdrawn fluid.

9. The method of claim 1 wherein the measured formation property is selected from the group consisting of electric resistivity, dielectric constant, magnetic resonance relaxation time, nuclear radiation, and combinations thereof.

10. The method of claim 1 further comprising measuring a plurality of property values associated with each of a plurality of sensing volumes of the formation proximate the hole.

11. A subsurface formation evaluation apparatus, comprising:

means for sealing a portion of a wall of a wellbore penetrating the formation;

means for forming a hole through the sealed portion of the wellbore wall;

means for injecting an injection fluid into the formation through the hole; and means for determining a saturation of the injection fluid in the formation based on a property of the formation measured proximate the hole while maintaining the sealed portion of the wellbore wall, wherein the hole forming means comprises means for extending a bit into the formation and further comprising means for introducing an electrical current into the formation from the bit, and wherein the measured formation property comprises a return electrical current.

12. The apparatus of claim 11 wherein the measured formation property is selected from the group consisting of electric resistivity, dielectric constant, magnetic resonance relaxation time, nuclear radiation, and combinations thereof.

13. The apparatus of claim 11 further comprising means for measuring a plurality of property values associated with each of a plurality of sensing volumes of the formation proximate the hole.

* * * * *